US010070699B2

(12) United States Patent
Bowerman

(10) Patent No.: US 10,070,699 B2
(45) Date of Patent: Sep. 11, 2018

(54) CLASP

(71) Applicant: Bowerbags, LLC, Savannah, GA (US)

(72) Inventor: James Patrick Bowerman, Savannah, GA (US)

(73) Assignee: Bowerbags, LLC, Savannah, GA (US)

( * ) Notice: Subject to any disclaimer, the term of this patent is extended or adjusted under 35 U.S.C. 154(b) by 0 days.

(21) Appl. No.: 14/967,482

(22) Filed: Dec. 14, 2015

(65) Prior Publication Data

US 2016/0095406 A1 Apr. 7, 2016

Related U.S. Application Data

(63) Continuation-in-part of application No. 14/355,887, filed as application No. PCT/US2012/063244 on Nov. 2, 2012, now Pat. No. 9,717,308.

(60) Provisional application No. 61/628,740, filed on Nov. 4, 2011.

(51) Int. Cl.

| | |
|---|---|
| ***A44B 11/04*** | (2006.01) |
| ***A45C 13/00*** | (2006.01) |
| ***A45F 3/00*** | (2006.01) |
| *A45F 5/00* | (2006.01) |
| *A45C 7/00* | (2006.01) |
| *A44B 17/00* | (2006.01) |

(52) U.S. Cl.

CPC ..... *A44B 11/04* (2013.01); *A45C 13/001* (2013.01); *A45F 3/00* (2013.01); *A44B 17/0041* (2013.01); *A45C 7/0086* (2013.01); *A45F 5/00* (2013.01); *A45F 2003/001* (2013.01)

(58) Field of Classification Search

CPC ..... A44B 11/04; A45C 13/001; A45C 7/0086; A45F 2003/001; A45F 3/00; A45F 5/00

See application file for complete search history.

(56) References Cited

U.S. PATENT DOCUMENTS

| | | | | | |
|---|---|---|---|---|---|
| 567,198 | A | * | 9/1896 | Richardson | A41F 1/00 24/670 |
| 653,315 | A | * | 7/1900 | Richardson | A44B 11/2526 24/323 |
| 710,123 | A | * | 9/1902 | Stearn | A41F 1/00 2/218 |
| 903,376 | A | * | 11/1908 | Hay | A41F 11/04 24/668 |
| 1,507,216 | A | * | 9/1924 | Stockton | A41F 1/00 24/595.1 |

(Continued)

*Primary Examiner* — David M Upchurch

(74) *Attorney, Agent, or Firm* — Blank Rome LLP

(57) ABSTRACT

A clasp for attaching a component to a bag having a strap. The clasp includes a protrusion portion having a protrusion and a receiving portion having a first arm and a second arm. The first and second arms define a receiving cavity configured to receive the protrusion of the protrusion portion. In one embodiment, the receiving portion further includes a body to which the first arm and second arm are connected by a plurality of flexible connectors. In another embodiment, the first arm is connected to the second arm by a clip. The arms of the receiving portion may each comprise a flexible extension which resists opening of the cavity. Alternatively or in addition, the receiving portion may further have a spring assembly which resists opening of the cavity. The receiving portion may further include one or more C-shaped strap retainers for attaching to the strap of the bag.

20 Claims, 25 Drawing Sheets

(56) References Cited

U.S. PATENT DOCUMENTS 1,775,098 A * 9/1930 Hodge ..... A41F 11/04 24/668
1,776,494 A * 9/1930 Domkee ..... A41F 11/04 24/668
1,806,825 A * 5/1931 Salisbury ..... A41F 11/04 24/647
1,890,692 A * 12/1932 Mosgrove ..... A41F 3/02 24/668
1,891,223 A * 12/1932 Domkee ..... A41F 11/04 24/668
1,916,010 A * 6/1933 Mosgrove ..... A41F 3/02 24/668
2,332,626 A * 10/1943 Elwell ..... A41F 11/04 24/668
2,888,727 A * 6/1959 Heimberger ..... A44B 19/22 24/389
3,734,551 A * 5/1973 Hughes ..... E05C 19/066 24/662
3,911,537 A * 10/1975 Mazur ..... A44B 19/301 24/387
4,027,710 A 6/1977 Keebler
4,270,247 A * 6/1981 Freedom ..... A45D 8/34 24/115 A
4,704,772 A * 11/1987 Kasai ..... E05C 19/066 24/669
4,935,997 A * 6/1990 Hirsch ..... A41F 11/04 24/668
5,706,561 A * 1/1998 Kipperman ..... A41F 11/04 24/666
5,845,378 A * 12/1998 Karmeli ..... A44C 7/003 24/705
6,070,309 A * 6/2000 Wong ..... A41F 3/02 24/668
6,138,881 A 10/2000 Paul et al.
6,510,592 B1 * 1/2003 Hamilton ..... A44B 11/06 24/170
7,007,353 B2 3/2006 Bergkvist
7,216,404 B1 * 5/2007 Doyle ..... A45F 5/02 206/286
7,575,376 B2 8/2009 Yu
7,857,181 B2 12/2010 Sacks
7,946,322 B2 5/2011 Valvano et al.
8,028,879 B2 10/2011 Amishay
2005/0040094 A1 * 2/2005 Meritt-Powell ..... B01D 29/27 210/232
2007/0164064 A1 7/2007 Nathan
2008/0277434 A1 11/2008 Sacks
2009/0180715 A1 7/2009 Wittke-Kothe
2011/0099777 A1 * 5/2011 Corry ..... A44C 7/003 24/705

* cited by examiner

CLASP

CROSS REFERENCE TO RELATED APPLICATIONS

This application is a continuation in part of U.S. application Ser. No. 14/355,887, entitled "Clasp," and filed May 2, 2014, which is a national phase application of International Patent Application No. PCT/US2012/063244, filed Nov. 2, 2012 and entitled "Clasp," which claims the benefit of U.S. Provisional Application No. 61/628,740, filed Nov. 4, 2011, the contents of which applications are incorporated herein by reference.

FIELD OF THE INVENTION

The disclosure relates generally to a clasp and more particularly to a clasp securable to a bag, the clasp comprising a receiving portion and a protrusion portion.

BACKGROUND OF THE INVENTION

Conventional bags, such as backpacks, often include multiple compartments and pockets for storing items. This configuration is often cumbersome, particularly when a user is not utilizing all or part of the storage space. One means of addressing the unused space is to have a bag with removable storage components. Conventional bags having removable storage components use attachment mechanisms for securing the storage components to the bag. Unfortunately, many of these attachment mechanisms are cumbersome and inefficient with regards to use, often making it harder to secure and remove the storage component than to use the bag with the excess compartments and storage pockets.

For example, storage compartments having zippers would require alignment of each side of the zipper and then the use of more than one hand to connect the storage compartment to the main bag body. Storage compartments employing a known clasp or clasps, typically with a spring, can also be inefficient to use in the sense that they often require two hands to operate.

Accordingly, a need exists for a clasp or springless clasp that can secure a first object to a second object with relative ease and speed. Moreover, the need exists for a clasp having a latch mechanism that can be operated with one hand.

SUMMARY OF THE INVENTION

In accordance with an aspect of the present invention, there is provided clasp. The clasp includes a protrusion portion having a protrusion and a receiving portion having a body, a first arm, and a second arm. The first and second arms define a receiving cavity configured to receive the protrusion of the protrusion portion. The first arm is connected to the body by a plurality of first flexible connectors. The second arm is connected to the body by a plurality of second flexible connectors. The protrusion is removably received in the cavity to engage the protrusion portion with the receiving portion.

In accordance with another aspect of the present invention, there is provided another clasp. The clasp includes a protrusion portion having a protrusion and a receiving portion having a spring assembly, a first arm, and a second arm defining a receiving cavity configured to receive the protrusion of the protrusion portion. The first arm and the second arm are biased toward one another by the spring assembly to resist opening of the cavity. The protrusion is removably received in the cavity to engage the protrusion portion with the receiving portion.

In accordance with yet another aspect of the present invention, there is provided yet another clasp. The clasp includes a protrusion portion having a protrusion and a receiving portion having a body, a first arm, a second arm, and a clip. The first and second arms define a receiving cavity configured to receive the protrusion of the protrusion portion. The clip secures the first arm to the second arm. The protrusion is removably received in the cavity to engage the protrusion portion with the receiving portion.

BRIEF DESCRIPTION OF THE DRAWINGS

For the purpose of illustration, there are shown in the drawings certain embodiments of the present invention. In the drawings, like numerals indicate like elements throughout. It should be understood that the invention is not limited to the precise arrangements, dimensions, and instruments shown. In the drawings.

DETAILED DESCRIPTION OF THE INVENTION

Figure 1:
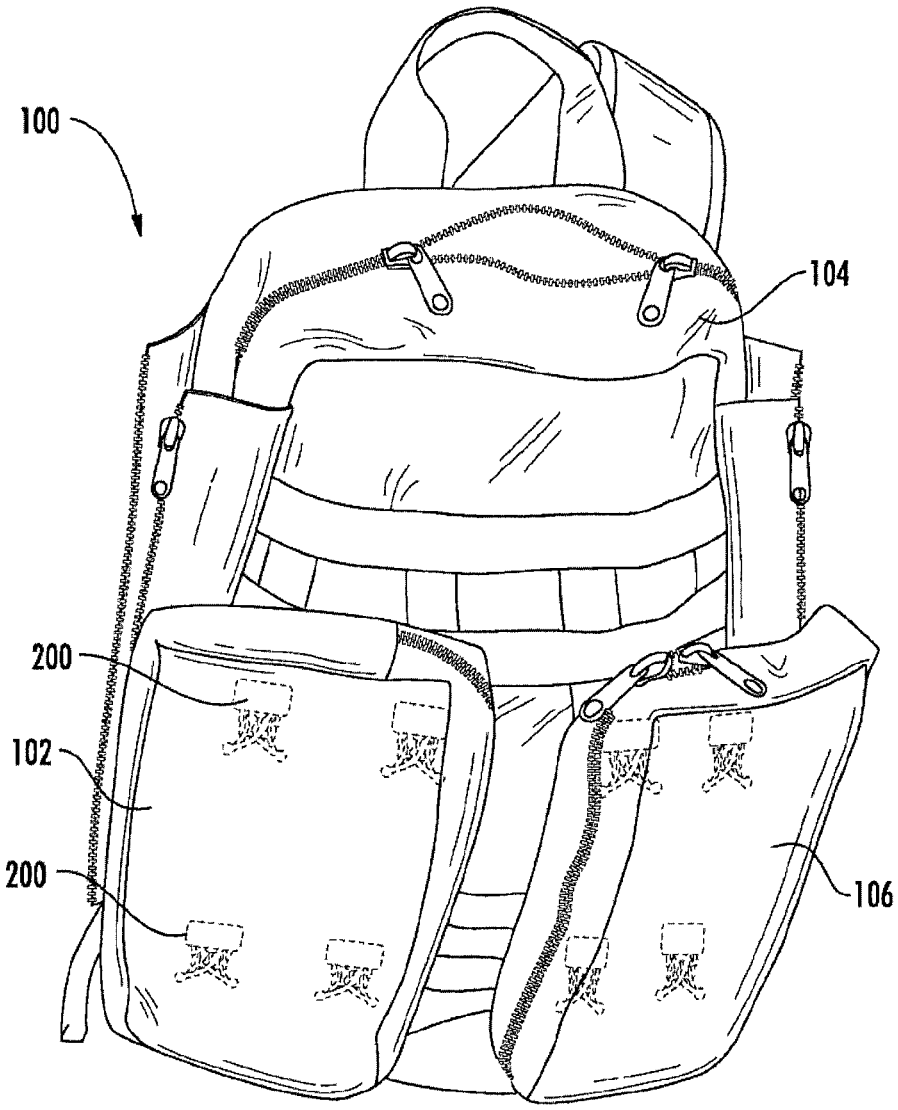
FIG. 1 is a front perspective view of a bag having at least one bag pocket attached with at least one clasp.

Reference to the drawings illustrating various views of exemplary embodiments of the present invention is now made. In the drawings and the description of the drawings herein, certain terminology is used for convenience only and is not to be taken as limiting the embodiments of the present invention. Furthermore, in the drawings and the description below, like numerals indicate like elements throughout.

Figure 2:
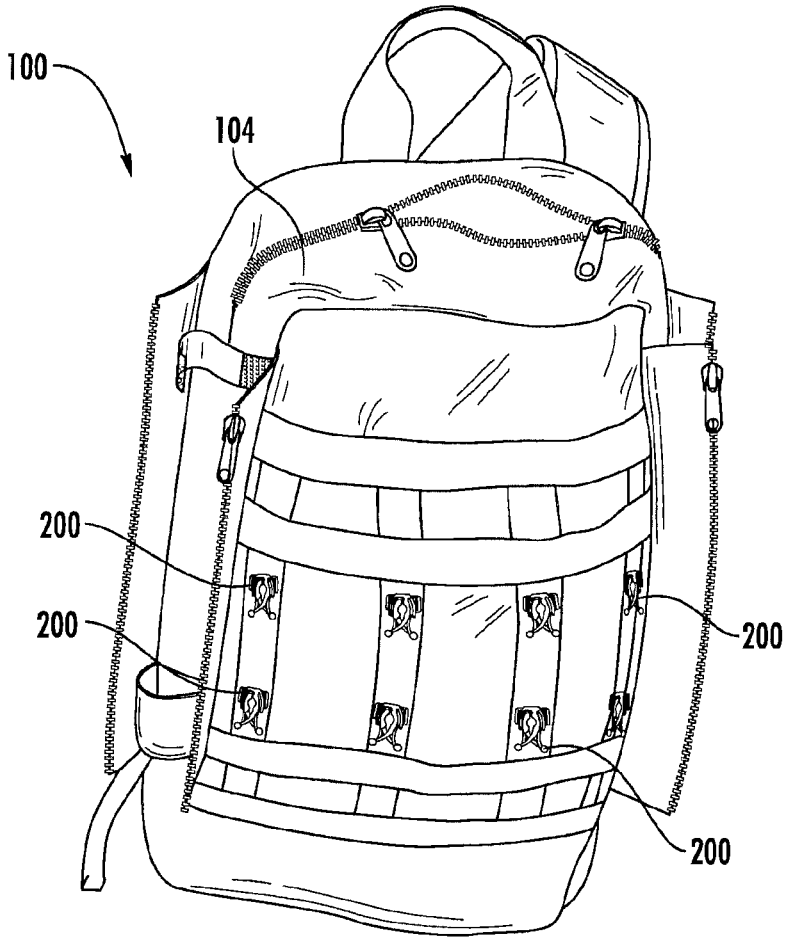
FIG. 2 is a front perspective view of the configurable bag of FIG. 1 with the at least one bag pocket having been removed.
Figure 3:
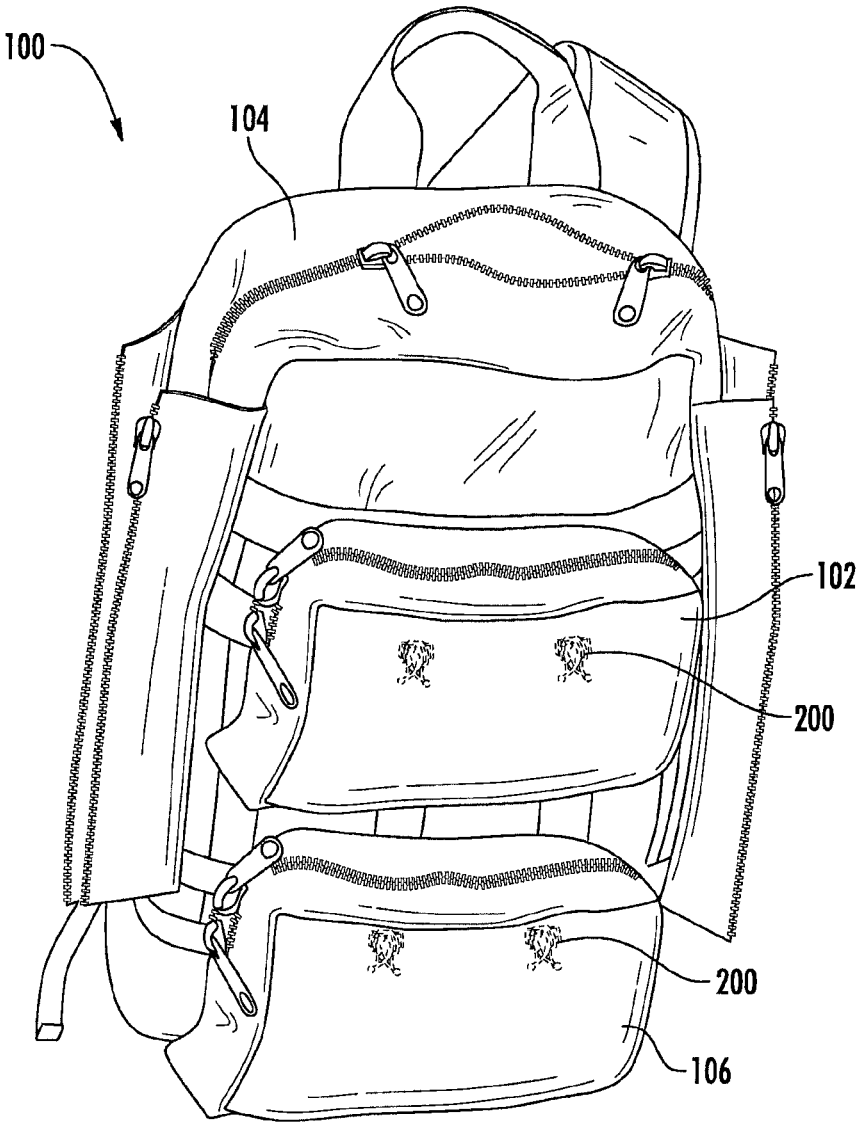
FIG. 3 is a front perspective view of the configurable bag of FIG. 1 with at least two bag pockets attached horizontally.

Referring to FIGS. 1-3, an exemplary embodiment of a configurable bag 100 having at least one component 102 removably associable therewith is illustrated. The component 102 may be a bag, pouch, water bottle, etc. In this configuration, the bag 100 is a backpack and includes a main bag body 104 with a front panel and a back panel. The bag 100 includes at least one bag pocket 102 attached thereto with a springless clasp 200 as well as a second bag pocket 106 attached adjacent the first bag pocket 102, also with a springless clasp 200. As seen in FIG. 1, the bag pockets 102, 106 are aligned vertically, with long ends disposed essentially parallel to a longitudinal axis of the bag.

Referring to FIGS. 2 and 3, the bag pockets 102, 106 can be removed from the vertical alignment (FIG. 2) and can also be arranged horizontally (FIG. 3) with long ends disposed essentially orthogonal to the longitudinal axis of the bag, such that the first bag pocket 102 is disposed above the second bag pocket 106 by activating alternative clasps 200 variously placed along the front panel of the main bag body 104.

Referring to FIGS. 4-7, an example of a clasp 200 used to attach the bag pockets 102, 106 to the main bag body 104 are shown in greater detail. The clasp 200 includes a protrusion portion 202 and a receiving portion 204. The protrusion portion 202 includes a protrusion 206 configured to be received by a cavity 208 defined by the receiving portion 204. The protrusion 206 is circular and raised from the surface of the protrusion base 210. The protrusion 206 is securable in the cavity 208 by a frictional fitting of the protrusion 206 into the cavity 208. The frictional fitting of the protrusion 206 into the cavity 208 creates a secure association of the at least one bag pocket 102 to the main bag body 104.

As shown in the Figures, the protrusion 206 includes a major protrusion diameter 212 and a minor protrusion diameter 214. The cavity 208 of the receiving portion is slightly smaller (or perhaps the same) in width than the major diameter 212 and slightly larger in width than the minor diameter 214. The width of the cavity 208 relative to the respective lengths of the major protrusion diameter 212 and minor protrusion diameter 214 facilitate the frictional fitting discussed above. The cavity 208 expands to a first size larger than or equal to the major protrusion diameter 212 and closes to a second size substantially equal to the minor protrusion diameter 214 as the protrusion 206 is pushed through and into the cavity 208. In an exemplary embodiment, the minor protrusion diameter 214 is adjacent the protrusion base 210.

Figure 4:
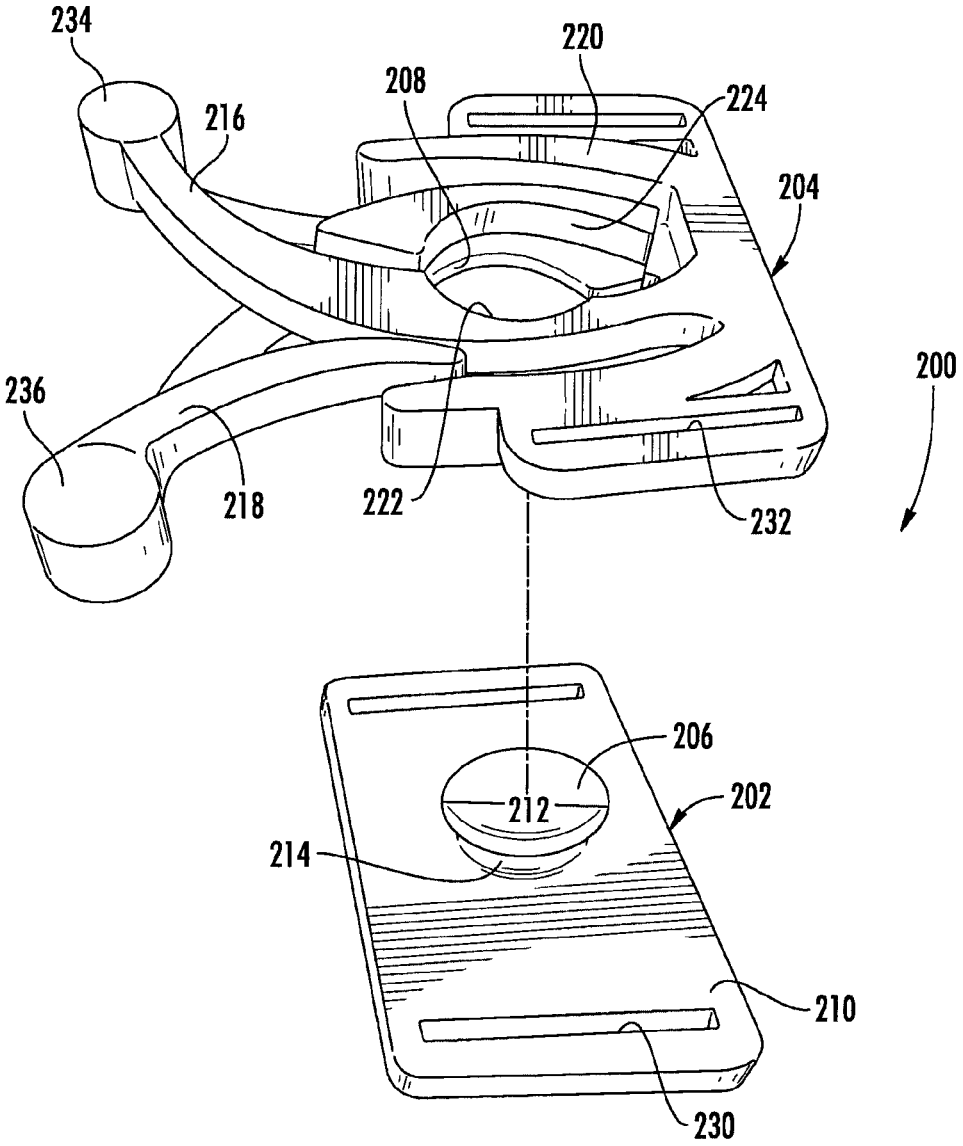
FIG. 4 is an exploded, front perspective view of the clasp in accordance with an exemplary embodiment.

As seen in FIG. 4, each receiving portion 204 includes a first arm 216 and a second arm 218 extending from a base 220 of the receiving portion 204. In an exemplary embodiment, portions of the first and second arms 216, 218 define the cavity 208. More specifically, the first arm 216 includes a first arcuate recess 222 and the second arm 218 includes a second arcuate recess 224 opposing the first arcuate recess 222. Each of the first and second arms 216, 218 could also include additional recesses wherein the third arcuate recess is adjacent the first arcuate recess 222 and the fourth arcuate recess is adjacent the second arcuate recess 224. The first and second arcuate recesses 222, 224 define the width of the cavity 208, which, as will be discussed in greater detail below, is adjustable via actuation of the arms 216, 218.

Figure 5:
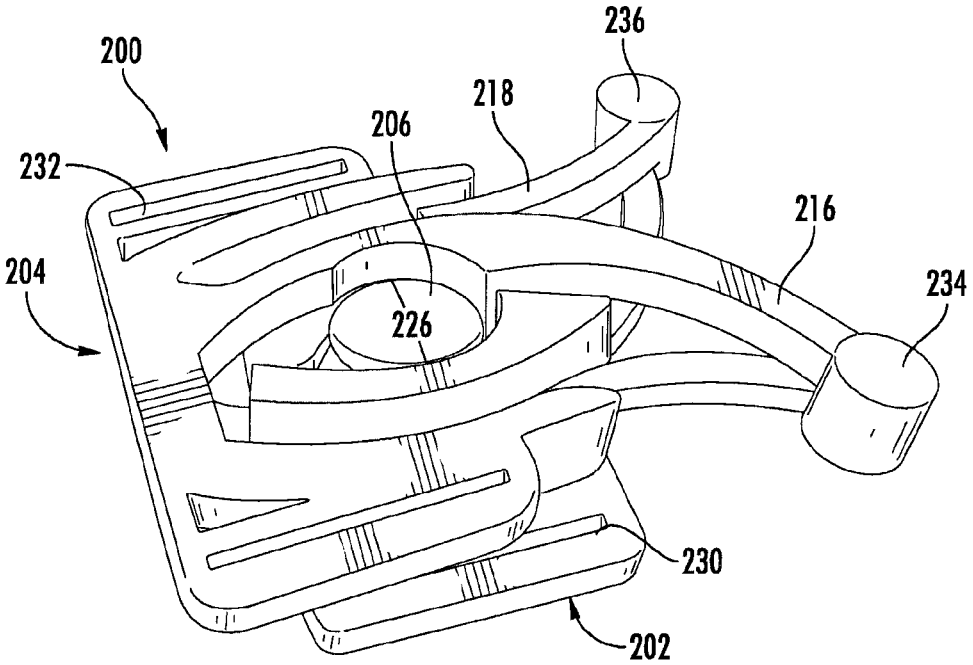
FIG. 5 is a front perspective engaged view of the clasp shown in FIG. 4.
Figure 6:
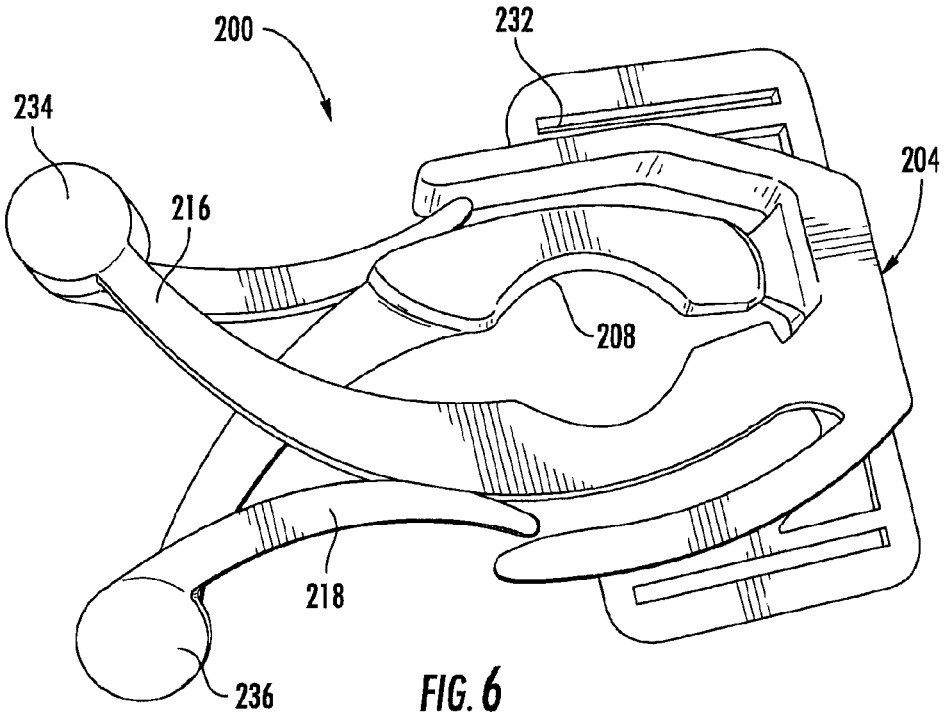
FIG. 6 is a top view of a receiving portion the clasp shown in FIG. 4 with first and second arms compressed.
Figure 7:
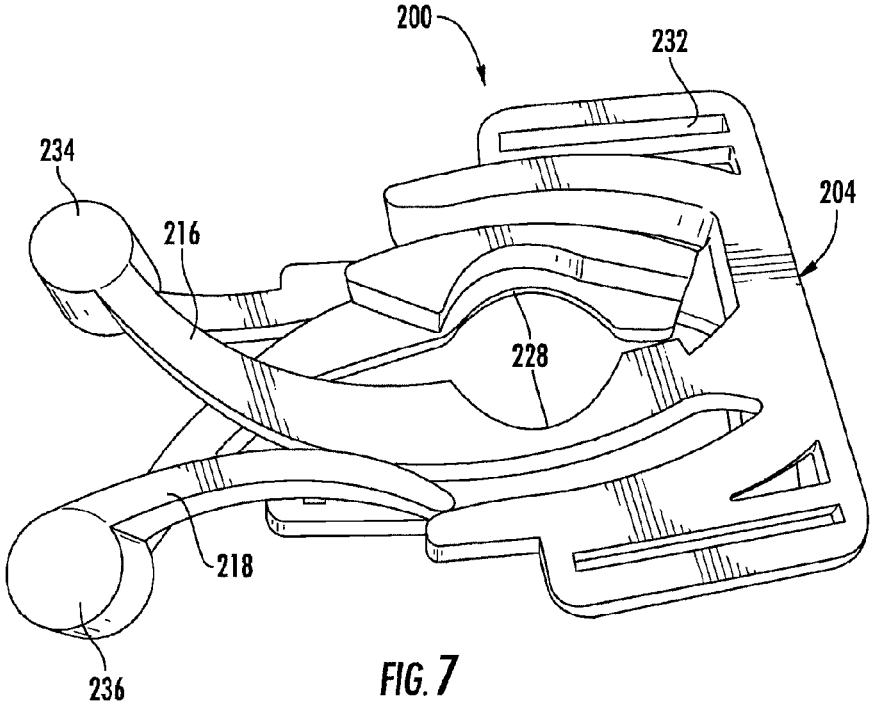
FIG. 7 is a bottom view of the receiving portion of the clasp shown in FIG. 6.

The cavity 208 includes a first width 226, as seen in FIG. 5, when the first and second arms 216, 218 are disposed in a resting position (as is also shown in FIG. 4). The first width 226 is adjustable into a second width 228, as seen in FIG. 7, when a compressing force is applied to the first arm 216 and the second arm 218 such that a distance between the furthest extents 234 and 236 of the first arm 216 and second arm 218 is decreased. The second width 228 of the cavity 208 is greater than the first width 226 of the cavity 208, and perhaps more importantly, the second width 228 is greater than the major protrusion diameter 212 so as to allow the protrusion 206 to be released from the cavity 208 via a compressive force applied to the first arm 216 and the second arm 218.

As seen in FIG. 4, the first arm 216 is horizontally and vertically displaced from the second arm 218 such that the first arm 216 is biased against the second arm 218 and the second arm 218 is biased against the first arm 216.

When the first arm 216 and second arm 218 are released and the user disengages the extents 234, 236, the second width 228 of the cavity adjusts into the first width 226 to secure the protrusion 206. The clasp 200 and its components may be made of a resilient plastic or metal material having a tendency to create a spring effect allowing the arms 216, 218 to easily move between compressed and released positions.

The protrusion portion 202 is affixed to a first object or a second object such as the main bag body 104 or to the at least one bag pocket 102 via a sewing, adhering, or strapping of the protrusion portion 202 to the first object or the second object such as the main bag body 104 or the at least one bag pocket 102. The receiving portion 204 is affixed to a first object or a second object such as the main bag body 104 or the at least one bag pocket 102 via a sewing, adhering, or strapping of the protrusion portion 202 to the first object or the second object such as the main bag body 104 or the at least one bag pocket 102.

As seen in FIG. 4, the protrusion portion 202 may also include at least one strap slot 230. The strap slot 230 is configured for receiving a strap or similar attachment element and affixing the protrusion portion 202 to at least one strap associated with a first object or a second object such as the main bag body 104 or the at least one bag pocket 102. Additionally, the receiving portion 204 may also include at least one strap slot 232. This strap slot 232 is also configured for receiving a strap or similar attachment element and affixing the protrusion portion 204 to at least one strap associated with the first object or the second object such as the main bag body 104 or the at least one bag pocket 102. The strap slots 230, 232 can be used for sewing or similarly attaching the protrusion portion 202 and/or receiving portion 204 to the main bag body 104 or the at least one bag pocket 102. While the illustrated strap slots 230, 232 are rectangular shaped, they could be any shape that would accommodate attachment to a related device.

As illustrated in FIGS. 1 and 3, an additional feature of the clasp 200 is the ability to connect the at least one bag pocket 102 in a vertical or horizontal orientation. Turning to FIG. 1, the bag pockets 102 are disposed vertically with respect to the longitudinal axis of the bag 100. As seen in FIG. 3, the bag pockets 102 are disposed horizontally with long ends disposed essentially perpendicular to the longitudinal axis of the bag. This is accomplished with the plurality of clasps 200. Specifically, one of the receiving portions 204 or protrusion portions 202 are embedded in the main bag body 104 and the other of the protrusion portions 202 or receiving portions 204 are secured to the bag pockets 102.

As seen in FIG. 2, the clasps 200 are evenly spaced along the main bag body 104 to account for the bag pockets 102 being disposed horizontally or vertically depending on which receiving portions 204 are engaged by the protrusion portions 202 (and vice versa).

Figure 8:
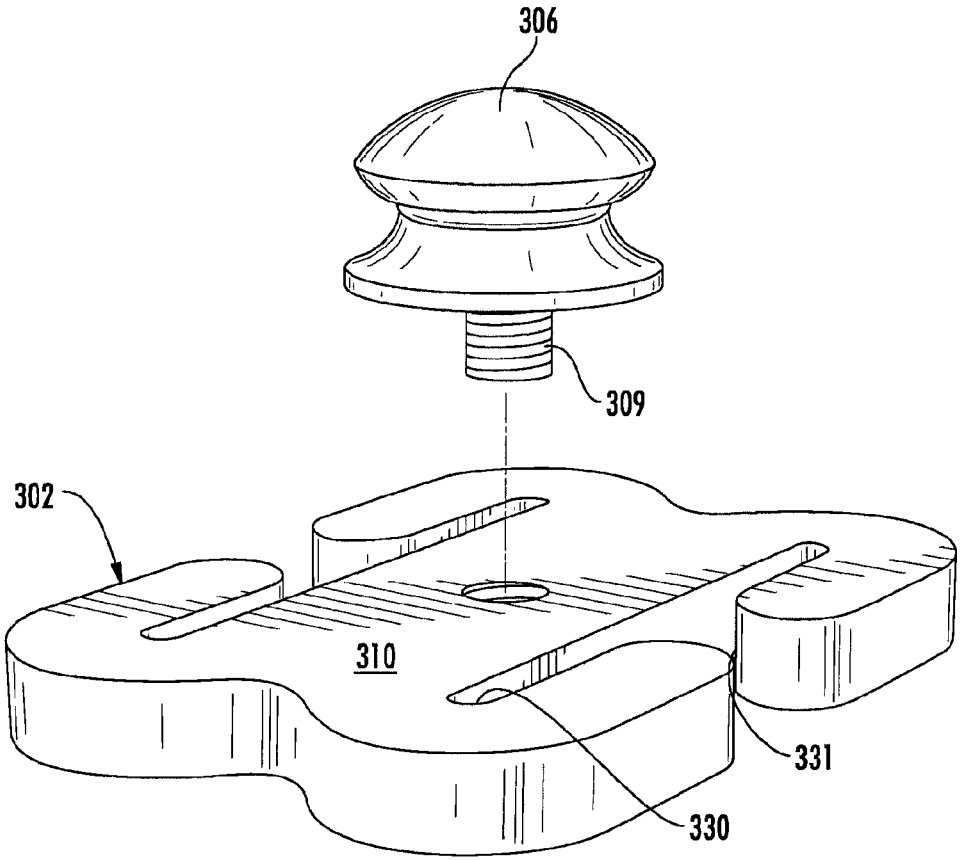
FIG. 8 is an exploded, front perspective view of a protrusion portion of a clasp according to another embodiment.

Referring to FIG. 8, another embodiment of a protrusion portion 302 will now be discussed. The protrusion portion 302 includes the same or similar features and configurations as that of portion 202, except where otherwise noted. In this embodiment 302, the protrusion 306 is removably associated with the protrusion base 310. In an exemplary embodiment, this removable association is accomplished via a screw 309 or other threaded attachment mechanism extending from the protrusion 306 and being threadable into the base 310. Via this embodiment, the protrusion 306 can be removed from the base 310 and threadingly attached to a device with a corresponding thread receiving cavity (i.e., camera, mobile phone case, or the like). Thereby, the protrusion 306 could be received in a cavity 308 of a corresponding receiving portion 304 in order to attach such a device. Of course, other attachment features besides thread association, such as but not limited to snaps, hook and loop material, adhesion, and other frictional fits, may also be used to removably associate the protrusion 306 with the base 301.

Figure 9:
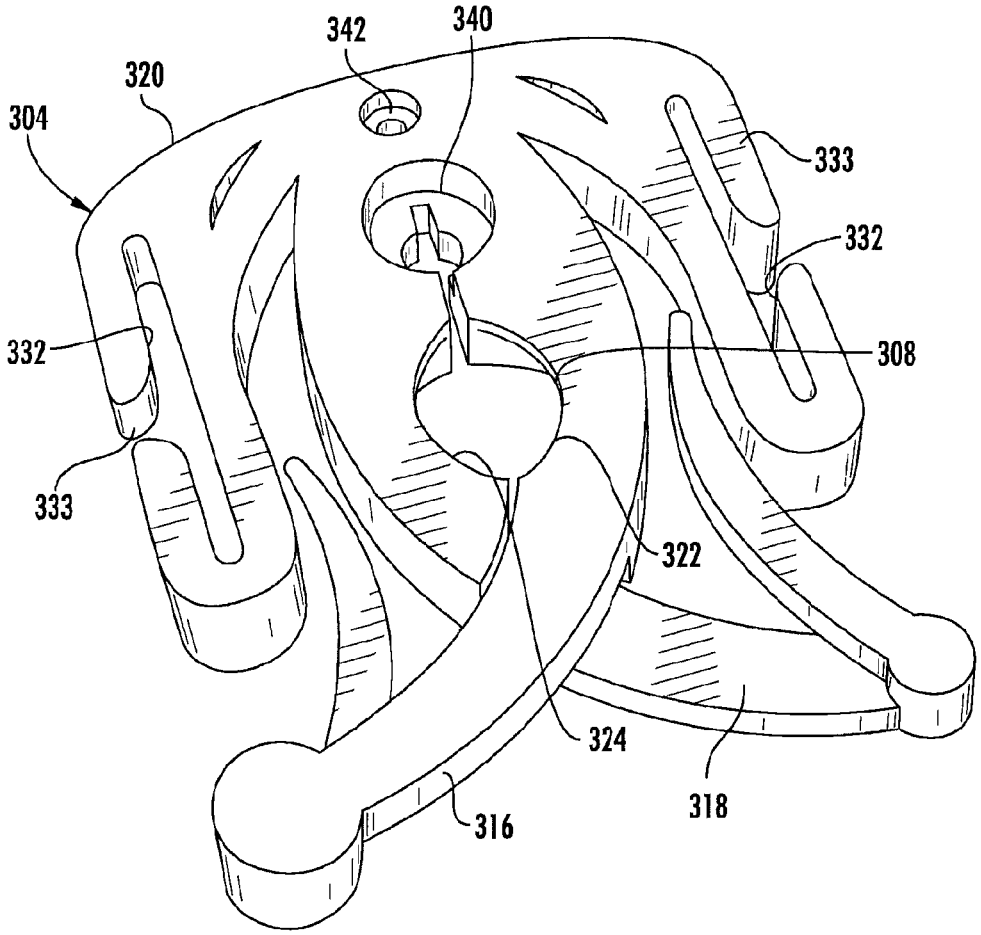
FIG. 9 is a top view of a receiving portion of the clasp according to another embodiment.
Figure 10:
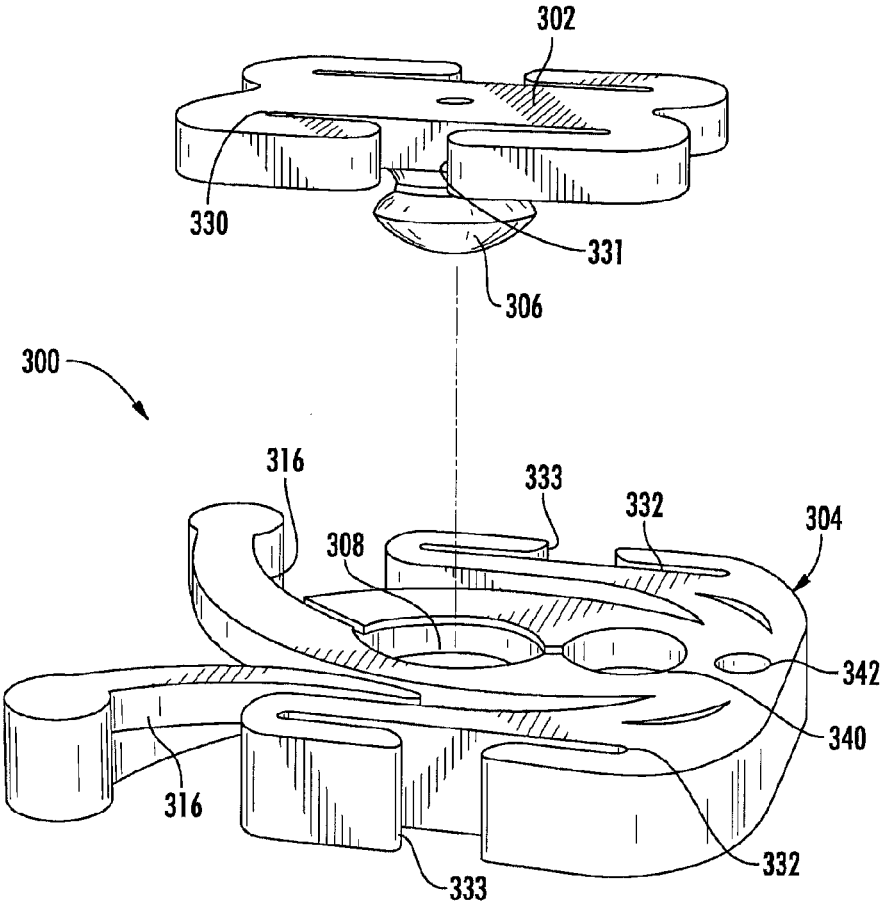
FIG. 10 is a side, exploded view of the clasp according to another embodiment.
Figure 11:
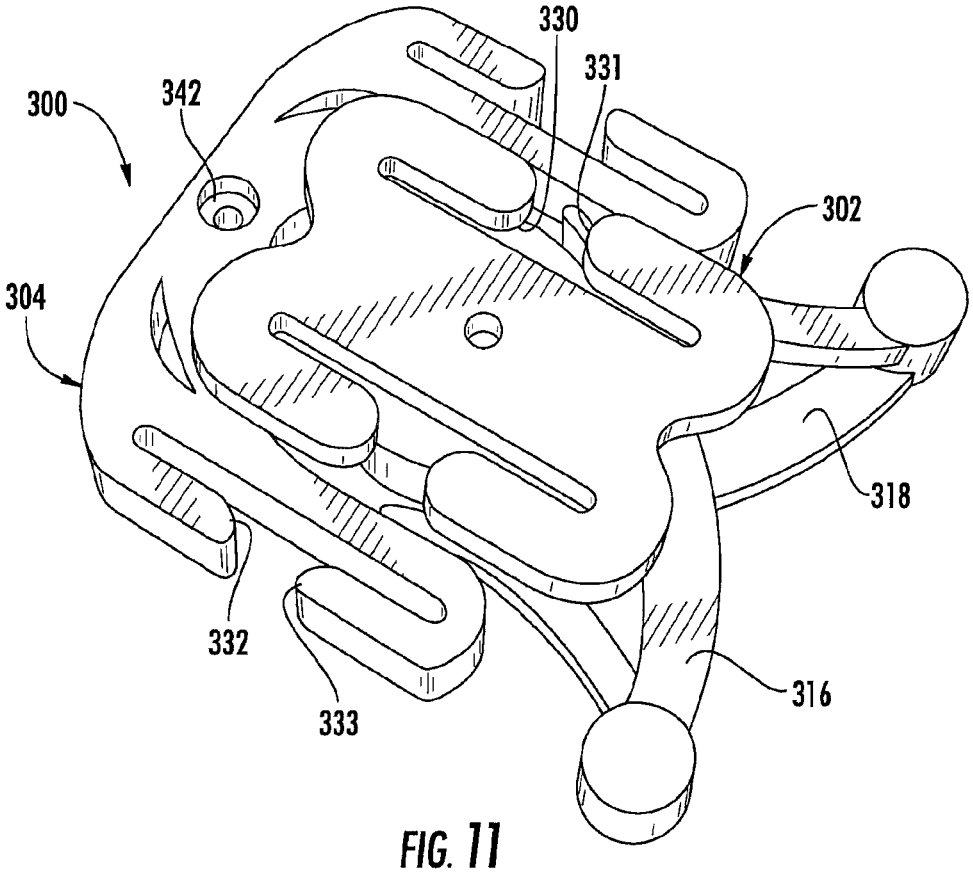
FIG. 11 is a top, perspective view of the clasp according to the another embodiment with the protrusion portion and the receiving portion engaged.

Referring to FIGS. 9-11, a full clasp 300 (showing the protrusion portion 302 by way of example, though any protrusion portion discussed herein may be used) including a receiving portion 304 is shown. As with the above discussed protrusion portion 302 this receiving portion 304 includes the same or similar features and configurations as that of portion 202, except where otherwise noted.

The receiving portion 304 in this exemplary embodiment includes a second cavity 340 in addition to and disposed adjacent the first cavity 308 (please see FIG. 9). The second cavity 340 is used in connection with a first attachment mechanism, such as a nail, for attaching the receiving portion 304 to a first object, such as a wall. Optionally, the receiving portion 304 can be rotated around the axis of the first attachment mechanism if a user intends to reposition the receiving portion 304. Thus, the clasp 300 can be used to mount an object on the first object, such as hanging a picture on a wall.

The clasp receiving portion 304 further includes a third cavity 342 disposed adjacent the second cavity 340. The third cavity 342 is used in connection with a second attachment mechanism, such as a nail, for securing the receiving portion 304 to the first object, such as the wall. The third cavity 342 is used for stabilizing the receiving portion 304 to prevent the receiving portion from spinning around the axis of the first attachment mechanism.

As illustrated in the exemplary embodiments of FIGS. 8-11, the protrusion portion 302 includes at least one strap slot 330 with a C-shaped configuration, and the receiving portion 304 also includes at least one strap slot 332 with a C-shaped configuration. These C-shaped configurations are formed via perpendicular openings 331 and 332, which communicate respective slots 330 and 332 the ambient environment disposed laterally to the clasp 300. These C-shaped configurations allows straps to be pinched or squeezed together and received in the respective slots 330 and 332 in either the receiving portion 304 or the protrusion portion 302.

Referring to FIGS. 12-15, there is illustrated a full clasp 1200 comprising a receiving portion 400 and a protrusion portion 490, in accordance with an exemplary embodiment of the present invention. The receiving portion 400 comprises a body 410, a first arm 420, and a second arm 430 extending from the body 410. The first arm 420 and the second arm 430 are curved and cross one another.

In an exemplary embodiment, portions of the first arm 420 and the second arm 430 define a cavity 440. More specifically, the first arm 420 has an outer surface 421 and an inner surface 423, the inner surface 423 including an arcuate recess 422, and the second arm 430 has an outer surface 431 and an inner surface 433, the inner surface 433 including an arcuate recess 432. The arcuate recesses 422 and 432 oppose one another to form the cavity 440.

In a further exemplary embodiment, portions of the first arm 420 and the second arm 430 define a lower ledge 450 in the cavity 440. Specifically, the first arm 420 further comprises a ledge 424 defined by an arcuate recess 422, and the second arm 430 further comprises a ledge 434 defined by an arcuate recess 432. The ledges 424 and 434 form the lower ledge 450 in the cavity 440. The ledge 450 comprises a gap 455 between the ledges 424 and 434.

The protrusion portion 490 comprises a base 495 and a protrusion 496 configured to be received by the cavity 440 defined by the receiving portion 400. The protrusion 496 is circular and raised from an upper surface 490A of the protrusion base 495. The protrusion 490 is securable in the cavity 440 by a frictional fitting of the protrusion 496 into the cavity 440. The frictional fitting of the protrusion 496 into the cavity 440 creates a secure association of the at least one bag pocket 102 to the main bag body 104.

The arcuate recesses 422, 432 define a width, $w_1$, of the cavity 440, which, as will be discussed in greater detail below, is adjustable via actuation of the arms 420, 430. The arcuate recesses 425, 435 define a width, $w_2$, of the gap 455.

Figure 12:
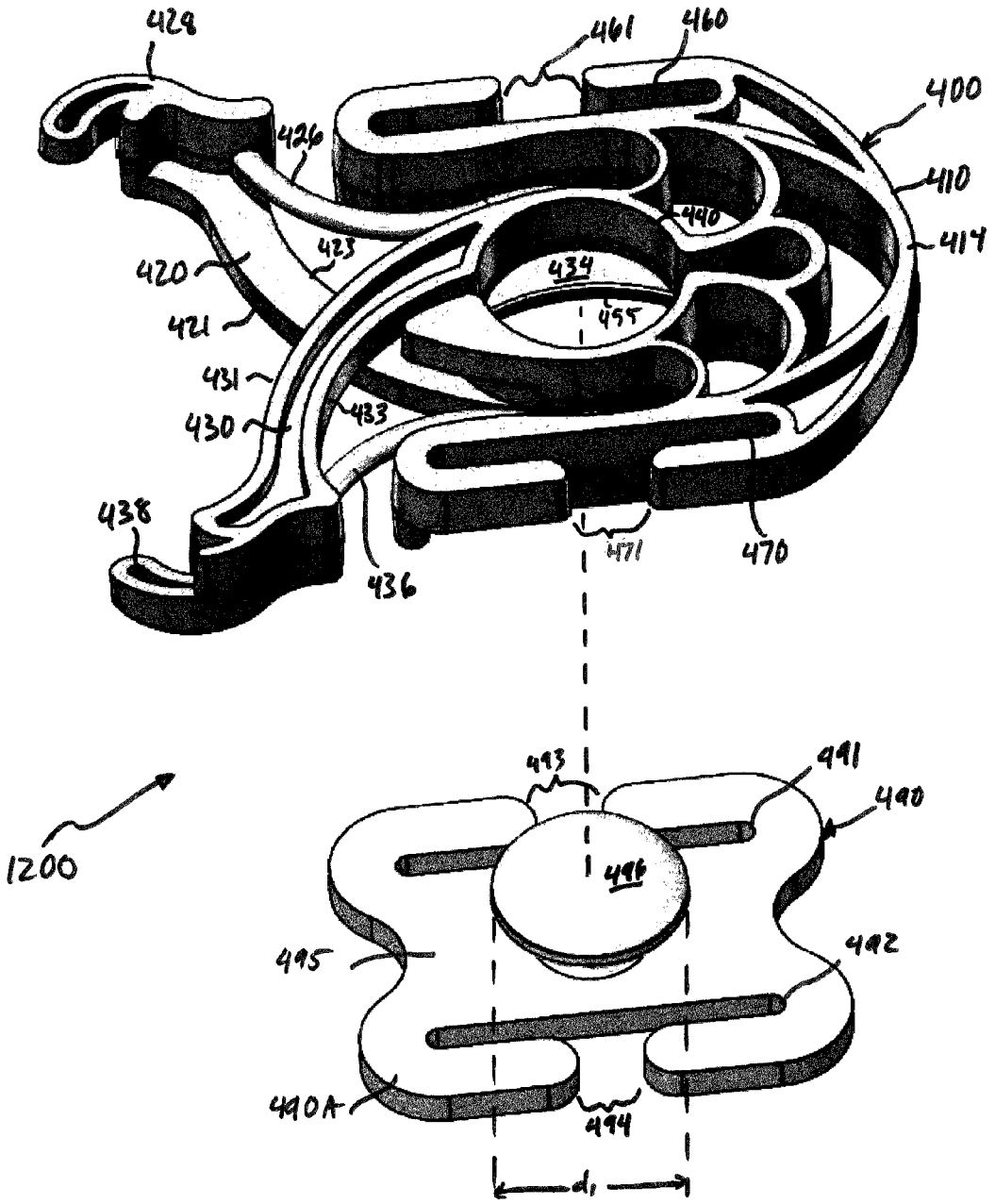
FIG. 12 is a perspective view of another embodiment of a clasp comprising a receiving portion and a protrusion portion, the receiving portion and the protrusion portion separated from one another, in accordance with an exemplary embodiment of the present invention.
Figure 13:
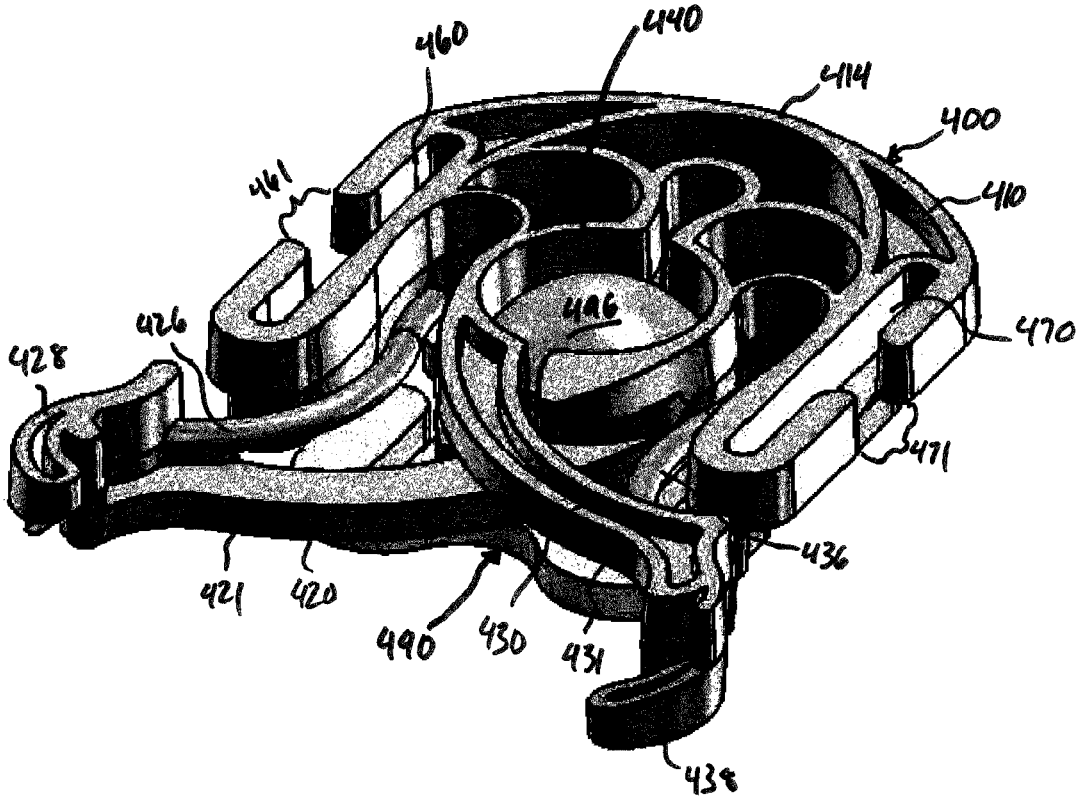
FIG. 13 is a perspective view of the clasp of FIG. 12 in which the protrusion portion is secured within the receiving portion, in accordance with an exemplary embodiment of the present invention.
Figure 14:
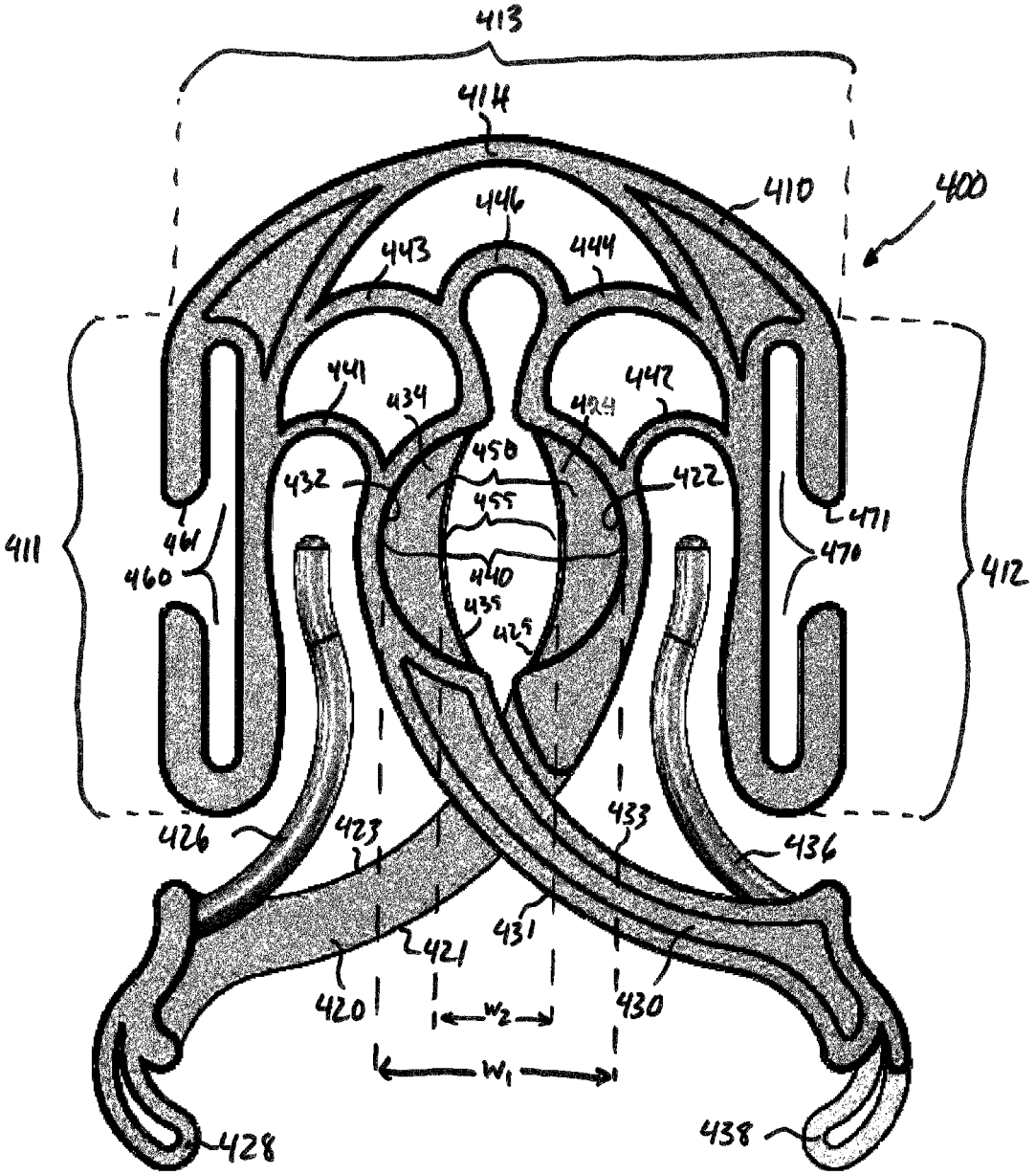
FIG. 14 is a top view of the receiving portion of the clasp of FIG. 12, in accordance with an exemplary embodiment of the present invention.

The widths, $w_1$ and $w_2$, have a first value when the first and second arms 420, 430 are disposed in a resting position, as is illustrated in FIGS. 12-14. The widths, $w_1$ and $w_2$, are adjustable into a second, greater value when a compressing force is applied to the first arm 420 and the second arm 430 such that a distance between the furthest extents 428 and 438 of the first arm 420 and second arm 430, respectively, is decreased. The second value of the width, $w_1$, of the cavity 440 is greater than the first value of the width, $w_1$, of the cavity 440, and the second value of the width, $w_2$, is greater than the diameter, $d_1$, of the protrusion 496 of the protrusion portion 490 so as to allow the protrusion 496 to be released from the cavity 440 (or placed into and secured in the cavity 440) via a compressive force applied to the first arm 420 and the second arm 430.

The first arm 420 further comprises a spring extension 426 extending from the furthest extent 428, and the second arm 430 further comprises a spring extension 436 extending from the furthest extent 438. When the first and second arms 420, 430 are disposed in the resting position illustrated in FIGS. 12-14, the spring extensions 426, 436 may also be in a resting position, as illustrated in FIGS. 12-14. When a compressing force is applied to the first arm 420 and the second arm 430, the spring extension 426 makes contact with the outer surface 421 of the first arm 420, and the spring extension 436 makes contact with the outer surface 431 of the second arm 430. When in contact with the respective outer surfaces 421, 431, the spring extensions 426, 436 resist the compression forced applied to the first arm 420 and the second arm 430 to urge the widths, $w_1$ and $w_2$, to return to their first values.

When the first arm 420 and second arm 430 are released and the user disengages the extents 428, 438, the spring extensions 426, 436 urge the widths, $w_1$ and $w_2$, to return to their first values. The receiving portion 400 and its components may be made of a resilient plastic or metal material having a tendency to create a spring effect allowing the arms 420, 430 to easily move between compressed and released positions.

As with the protrusion 206, the protrusion 496 includes a major protrusion diameter, $d_1$, and a minor protrusion diameter, $d_2$. The first value of the width, $w_1$, of the cavity 440 of the receiving portion 400 is slightly larger (or perhaps the same) than the major protrusion diameter, $d_1$. The first value of the width, $w_2$, of the gap 455 of the receiving portion 400 is slightly larger (or perhaps the same) than the minor protrusion diameter, $d_2$. The widths of the cavity 440 and the gap 455 relative to the respective major protrusion diameter, $d_1$, and minor protrusion diameter, $d_2$, trap the protrusion 496 within the cavity 440.

When a compressing force is applied to the first arm 420 and the second arm 430, the widths, $w_1$ and $w_2$, increase from their first values. When the width, $w_2$, of the gap 455 exceeds the diameter, $d_1$, of the protrusion 496, the protrusion 496 may be disposed within the cavity 440. When the compressing force is removed from to the first arm 420 and the second arm 430, the widths, $w_1$ and $w_2$, return to their first values. The width, $w_2$, of the gap 455 reduces to the first value to secure the protrusion 496 in the cavity 440.

The protrusion portion 490 also comprises a strap slot 491 and a strap slot 492. The strap slot 491 comprises an opening 493 for receiving a portion of a strap, and the strap slot 492 comprises an opening 494 for receiving another portion of the same strap or another strap. Each strap slot 491, 492 is formed from a respective pair of extensions that extend outwardly from the base 495 and curve toward one another but do not touch so that they form respective openings 493, 494 therebetween.

The receiving portion 400 also comprises a first C-shaped strap retainer formed in a first side portion 411 of the body 410. The first C-shaped strap retainer is formed from two extensions of the body 410 that extend outwardly and curve toward one another but are separated from one another by a gap or opening 461 for receiving a portion of a strap. The extensions define a strap slot 460 for a portion of a strap. The portion of the strap is retained in the slot 460 by the first C-shaped strap retainer and cannot escape unless removed by the user.

The receiving portion 400 also comprises a second C-shaped strap retainer formed in a second side portion 412 of the body 410. The second C-shaped strap retainer is formed from two further extensions of the body 410 that extend outwardly and curve toward one another but are separated from one another by a gap or opening 471 for receiving another portion of the strap. The extensions define a strap slot 470 for the other portion of the strap. Such other portion of the strap is retained in the slot 470 by the second C-shaped strap retainer and cannot escape unless removed by the user.

The receiving portion 400 is generally flat and lies in a first plane. The portions 411 and 412 lie within the first plane but are also aligned with one another in respective parallel second planes that are perpendicular to the first plane. A strap may be disposed within the strap slots 460 and 470 by orienting it in a third plane that is perpendicular to such first and second planes. So oriented, the strap is inserted while perpendicular to the openings 461 and 471 so that the strap may be slid into the strap slots 460 and 470. In an exemplary embodiment, the strap slots 460 and 470 are parallel to one another and to a longitudinal axis of the receiving portion 400.

The body 410 further comprises curved support connections 441, 442, 443, 444, and 446. The first arm 420 is connected to the body 410 by the first and second support connections 441 and 443. Specifically, the support connections 441 and 443 connect the first arm 420 in the vicinity of the cavity 440 to the first portion 411 of the body 410. The support connection 441 connects a portion of the arm 430 near a distal end of the arm 430 to a portion of the body 410 near a distal end of the first portion 411 of the body 410. The support connection 443 connects the extreme distal end of the arm 430 to the extreme distal end of the first portion 411 of the body 410. The second arm 430 is connected to the body 410 by the third and fourth support connections 442 and 444. Specifically, the support connections 442 and 444 connect the second arm 430 in the vicinity of the cavity 440 to the second portion 412 of the body 410. The support connection 442 connects a portion of the arm 420 near a distal end of the arm 420 to a portion of the body 410 near a distal end of the second portion 412 of the body 410. The support connection 444 connects the extreme distal end of the arm 420 to the extreme distal end of the second portion 412 of the body 410.

The connectors 443 and 444 are connected to one another by the central support connection 446. The support connections 441-444 and 446 are curved and sized to be flexible relative to the arms 420 and 430. A central portion 414 of a top portion 413 of the body 410 is also sized to be flexible relative to the rest of the body 410. When a compressing force is applied to the first arm 420 and the second arm 430, the support connections 441-444 and 446 and the central portion 414 of the top portion 413 of the body 410 flex to allow the widths, $w_1$ and $w_2$, to increase. However, the support connections 441-444 and 446 and the central portion 414 of the top portion 413 of the body 410 resist such flexing. When the compressing force is removed from the first arm 420 and the second arm 430, the support connections 441-444 and 446 and the central portion 414 of the top portion 413 of the body 410 urge the furthest extents 428 and 438 of the respective arms 420 and 430 away from one another, thereby causing the widths, $w_1$ and $w_2$, to decrease and the cavity 440 to close. Accordingly, the support connections 441-444 and 446 and the central portion 414 of the top portion 413 of the body 410 bias the arms 420 and 430 to close to reliably retain the protrusion 496 within the cavity 440 when no force is applied to the arms 420 and 430. The user must press the arms 420 and 430 inwardly toward one another against the bias of the support connections 441-444 and 446 and the central portion 414 of the top portion 413 of the body 410 to open the cavity 440 so that the protrusion 496 can be inserted or removed. Accordingly, the support connections 441-444 and 446 and the central portion 414 of the top portion 413 of the body 410 lend added support and strength to the arms 420 and 430.

In an exemplary embodiment, the receiving portion 400 is formed as a unitary structure. Thus, the body 410 and the arms 420 and 430 are formed as a unitary structure made from a single material. In an exemplary embodiment the support connections 441-444 and 446 are thin members sized to be flexible. The receiving portion 400 may be formed from a flexible plastic to provide for the flexibility of the support connections 441-444 and 446. Any known flexible plastic, such as nylon, polypropylene, etc., may be used for the receiving portion 400. Alternatively, the receiving portion 400 may be formed from a metal, such as aluminum, spring steel, etc. It is also contemplated that the receiving portion 400 may be formed from materials other than plastics or metals. Such other materials may include carbon fibers, Kevlar® weaves, etc.

Figure 15:
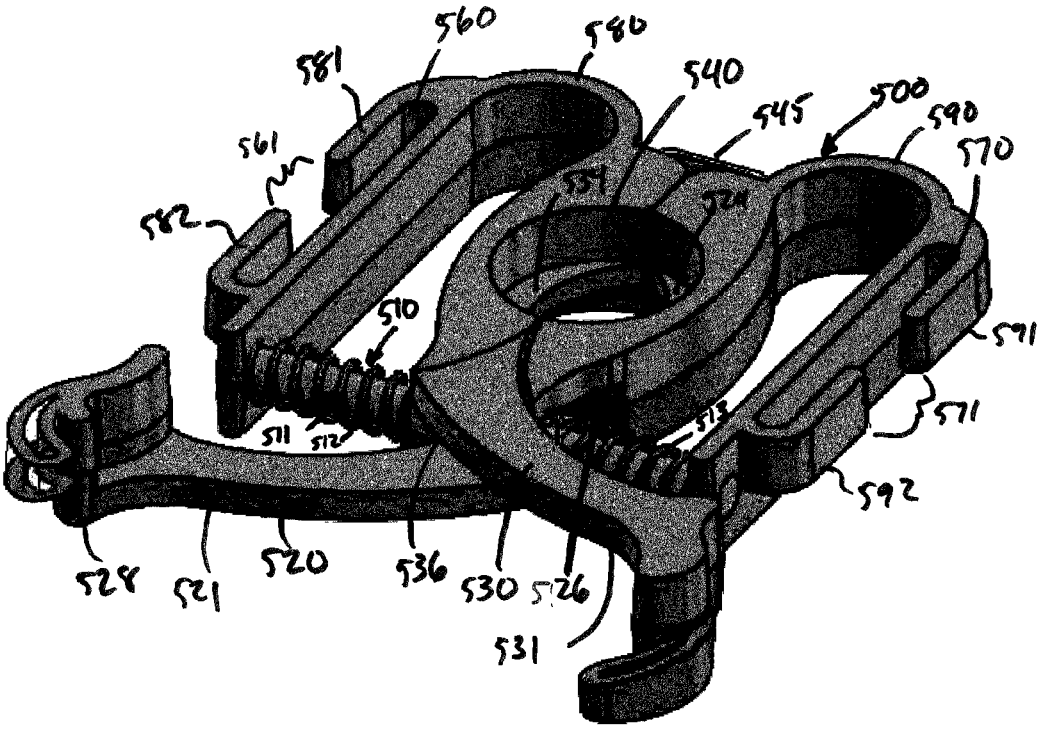
FIG. 15 is a perspective view of yet another embodiment of a receiving portion, in accordance with an exemplary embodiment of the present invention.
Figure 16:
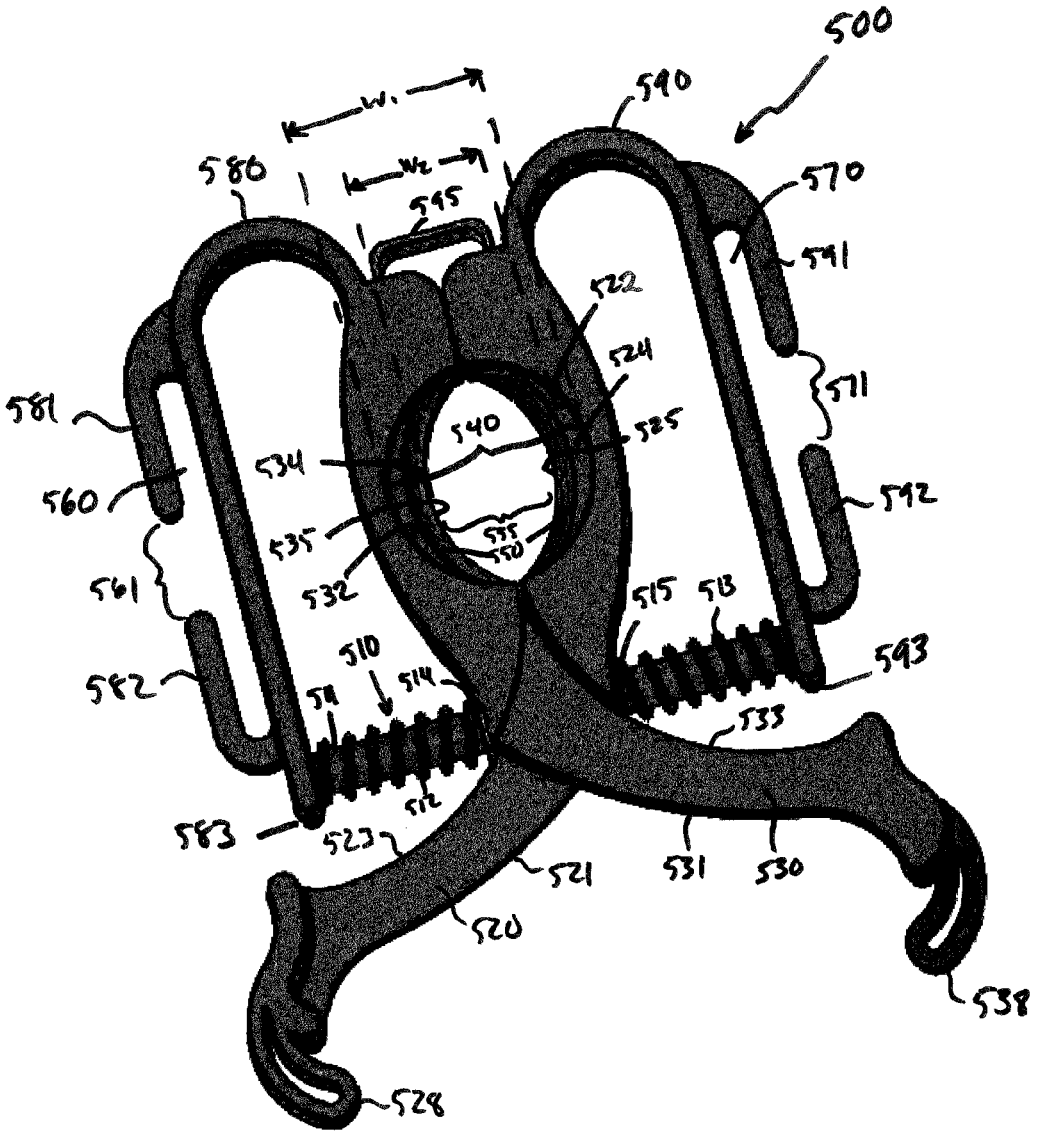
FIG. 16 is a top view of the receiving portion of FIG. 15, in accordance with an exemplary embodiment of the present invention.
Figure 17:
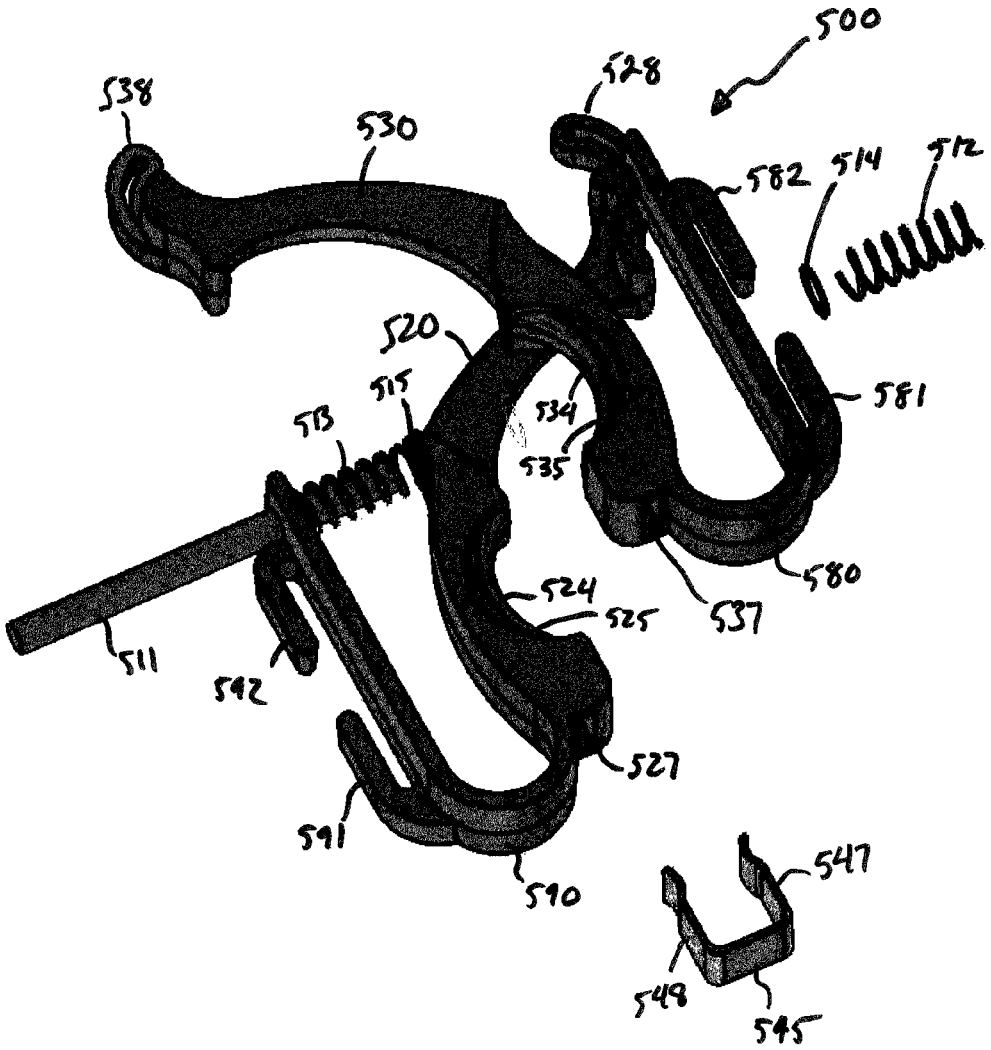
FIG. 17 is an exploded view of the receiving portion of FIG. 15, in accordance with an exemplary embodiment of the present invention.

Referring to FIGS. 15-17, there is illustrated a receiving portion 500 for use in a clasp comprising the receiving portion 500 and the protrusion portion 490, in accordance with an exemplary embodiment of the present invention. The receiving portion 500 is configured for receiving a protrusion of a protrusion portion, such as the protrusion 496 of the protrusion portion 490. The receiving portion 500 comprises a spring assembly 510, a first arm 520, a second arm 530, and a spring clamp 545.

In an exemplary embodiment, portions of the first arm 520 and the second arm 530 define a cavity 540. More specifically, the first arm 520 has an outer surface 521 and an inner surface 523, the inner surface 523 including an arcuate recess 522, and the second arm 530 has an outer surface 531 and an inner surface 533, the inner surface 533 including an arcuate recess 532. The arcuate recesses 522 and 532 oppose one another to form the cavity 540.

In a further exemplary embodiment, portions of the first arm 520 and the second arm 530 define a lower ledge 550 in the cavity 540. Specifically, the first arm 520 further comprises a ledge 524 defined by an arcuate recess 525, and the second arm 530 further comprises a ledge 534 defined by an arcuate recess 535. The ledges 524 and 534 form the lower ledge 550 in the cavity 540. The ledge 550 comprises a gap 555 between the ledges 524 and 534.

The arcuate recesses 522, 532 define the width, $w_1$, of the cavity 540, which, as will be discussed in greater detail below, is adjustable via actuation of the arms 520, 530. The arcuate recesses 525, 535 define the width, $w_2$, of the gap 555.

The widths, $w_1$ and $w_2$, have a first value when the first and second arms 520, 530 are disposed in a resting position, as is illustrated in FIGS. 15-17. The widths, $w_1$ and $w_2$, are adjustable into a second, greater value when a compressing force is applied to the first arm 520 and the second arm 530 such that a distance between the furthest extents 528 and 538 of the first arm 520 and second arm 530, respectively, is decreased. The second value of the width, $w_1$, of the cavity 540 is greater than the first value of the width, $w_1$, of the cavity 540, and the second value of the width, $w_2$, is greater than the diameter, $d_1$, of the protrusion 496 of the protrusion portion 490 so as to allow the protrusion 496 to be released from the cavity 540 (or placed into and secured in the cavity 540) via a compressive force applied to the first arm 520 and the second arm 530.

The first arm 520 further comprises a curved extension 590 on which slot extensions 591 and 592 are disposed. The slot extensions 591, 592 form a C-shaped strap slot 570 having an opening 571. The second arm 530 further comprises a curved extension 580 on which slot extensions 581 and 582 are disposed. The slot extensions 581, 582 form a C-shaped strap slot 560 having an opening 561.

The spring assembly 510 comprises a pin 511, a first spring 512, a second spring 513, a first washer 514, and a second washer 515. A first end of the pin 511 is secured to an end 583 of the curved extension 580, and a second end of the pin 511 is secured to an end 593 of the curved extension 590. The spring 512 is disposed about the pin 511 between the end 583 of the curved extension 580 and the outer surface 531 of the arm 530. The spring 513 is disposed about the pin 511 between the end 593 of the curved extension 590 and the outer surface 521 of the arm 520. The pin 511 passes through passageways 526 and 536 in the respective arms 520 and 530. The washer 514 prevents the spring 512 from entering the passageway 536, and the washer 515 prevents the spring 513 from entering the passageway 526.

When the first and second arms 520, 530 are disposed in the resting position illustrated in FIGS. 15-17, the springs 511, 512 may be under moderate compression, as illustrated in FIGS. 15-17, thereby maintaining the widths, $w_1$ and $w_2$, at their first values. When a compressing force is applied to the first arm 520 and the second arm 530, the springs 511, 512 are compressed further between their respective curved extensions 580, 590 and washers 514, 515 and resist the compression forced applied to the first arm 420 and the second arm 430 to urge the widths, $w_1$ and $w_2$, to return to their first values. When the first arm 520 and second arm 530 are released and the user disengages the extents 528, 538, the spring assembly 510 urge the widths, $w_1$ and $w_2$, to return to their first values.

When a compressing force is applied to the first arm 520 and the second arm 530, the portions of the first arm 520 and the second arm 530 adjacent to the cavity 540 pivot away from one another, thereby opening the widths, $w_1$ and $w_2$, to their second values. When the width, $w_2$, of the gap 555 exceeds the diameter, $d_1$, of the protrusion 496, the protrusion 496 may be disposed within the cavity 540. When the compressing force is removed from to the first arm 4520 and the second arm 530, the widths, $w_1$ and $w_2$, return to their first values. The width, $w_2$, of the gap 555 reduces to the first value to secure the protrusion 496 in the cavity 440. To remove the protrusion 496 from within the cavity 440, the compressing force is reapplied to the first arm 520 and the second arm 530 to open the cavity 540.

The protrusion 496 of the protrusion portion 490 is securable in the cavity 540 by a frictional fitting of the protrusion 496 into the cavity 540. The frictional fitting of the protrusion 496 into the cavity 440 creates a secure association of the at least one bag pocket 102 to the main bag body 104.

The spring clamp 545 of the receiving portion 500 connects the arms 520, 530 together and provides a pivot point between the arms 520, 530. The clamp 545 comprises arms 547 and 548 that are disposed within respective slots 527 and 537 at the top distal ends of the respective arms 520 and 530. The clamp 545 is thus C-shaped. In an exemplary embodiment, the spring clamp 545 resists the arms 650, 530 pivoting away from one another.

In an exemplary embodiment the curved extensions 580, 590 are thin members sized to be flexible. The arms 520, 530 may be formed from a flexible plastic to provide for the flexibility of the curved extensions 580, 590. Any known flexible plastic, such as nylon, polypropylene, etc., may be used for the arms 520, 530. Alternatively, the arms 520, 530 may instead be formed from a metal, such as aluminum, spring steel, etc. It is also contemplated that the arms 520, 530 may be formed from materials other than plastics or metals. Such other materials may include carbon fibers, Kevlar® weaves, etc.

Referring to FIGS. 18-21, there is illustrated a receiving portion 600 for use in a clasp comprising the receiving portion 600 and the protrusion portion 490, in accordance with an exemplary embodiment of the present invention. The receiving portion 600 is configured for receiving a protrusion of a protrusion portion, such as the protrusion 496 of the protrusion portion 490. The receiving portion 600 comprises a first arm 620, a second arm 630, and a spring clamp 645. The first arm 620 and the second arm 630 are generally flat (except for extensions 681, 682, 691, and 692 discussed below) and lie in a plane.

In an exemplary embodiment, portions of the first arm 620 and the second arm 630 define a cavity 640. More specifically, the first arm 620 has an outer surface 621 and an inner surface 623, the inner surface 623 including an arcuate recess 622, and the second arm 630 has an outer surface 631 and an inner surface 633, the inner surface 633 including an arcuate recess 632. The arcuate recesses 622 and 632 oppose one another to form the cavity 640.

In a further exemplary embodiment, portions of the first arm 620 and the second arm 630 define a lower ledge 650 in the cavity 640. Specifically, the first arm 620 further comprises a ledge 624 defined by an arcuate recess 625, and the second arm 630 further comprises a ledge 634 defined by an arcuate recess 635. The ledges 624 and 634 form the lower ledge 650 in the cavity 640. The ledge 650 comprises a gap 655 between the ledges 624 and 634.

The arcuate recesses 622, 632 define the width, $w_1$, of the cavity 640, which, as will be discussed in greater detail below, is adjustable via actuation of the arms 620, 630. The arcuate recesses 625, 635 define the width, $w_2$, of the gap 655.

The widths, $w_1$ and $w_2$, have a first value when the first and second arms 620, 6530 are disposed in a resting position, as is illustrated in FIGS. 18-21. The widths, $w_1$ and $w_2$, are adjustable into a second, greater value when a compressing force is applied to the first arm 620 and the second arm 630 such that a distance between the furthest extents 628 and 638 of the first arm 620 and second arm 630, respectively, is decreased. The second value of the width, of the cavity 640 is greater than the first value of the width, $w_1$, of the cavity 640, and the second value of the width, $w_2$, is greater than the diameter, $d_1$, of the protrusion 496 of the protrusion portion 490 so as to allow the protrusion 496 to be released from the cavity 640 (or placed into and secured in the cavity 640) via a compressive force applied to the first arm 620 and the second arm 630.

Figure 18:
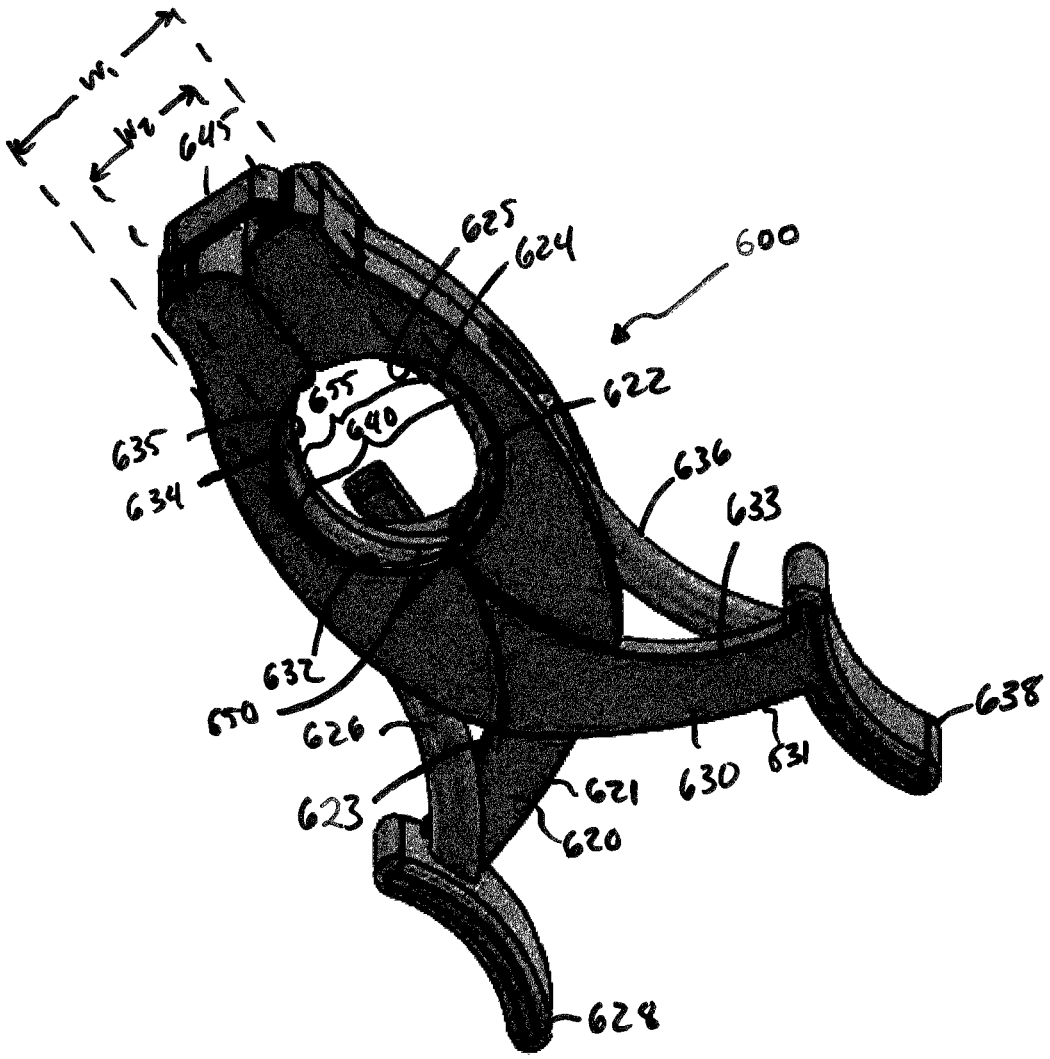
FIG. 18 is a perspective view of still another embodiment of a receiving portion, in accordance with an exemplary embodiment of the present invention.
Figure 19:
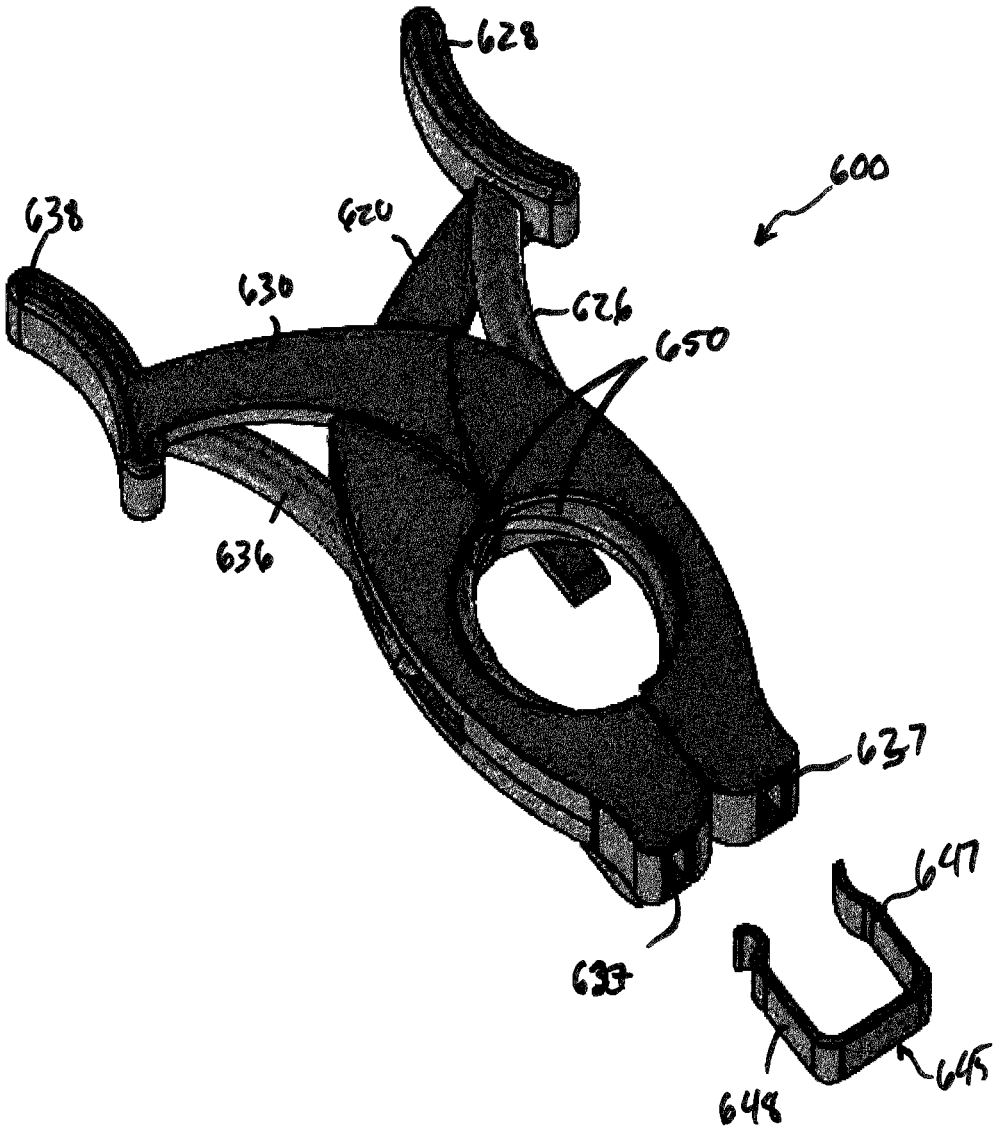
FIG. 19 is a partially exploded view of the receiving portion of FIG. 18, in accordance with an exemplary embodiment of the present invention.
Figure 20:
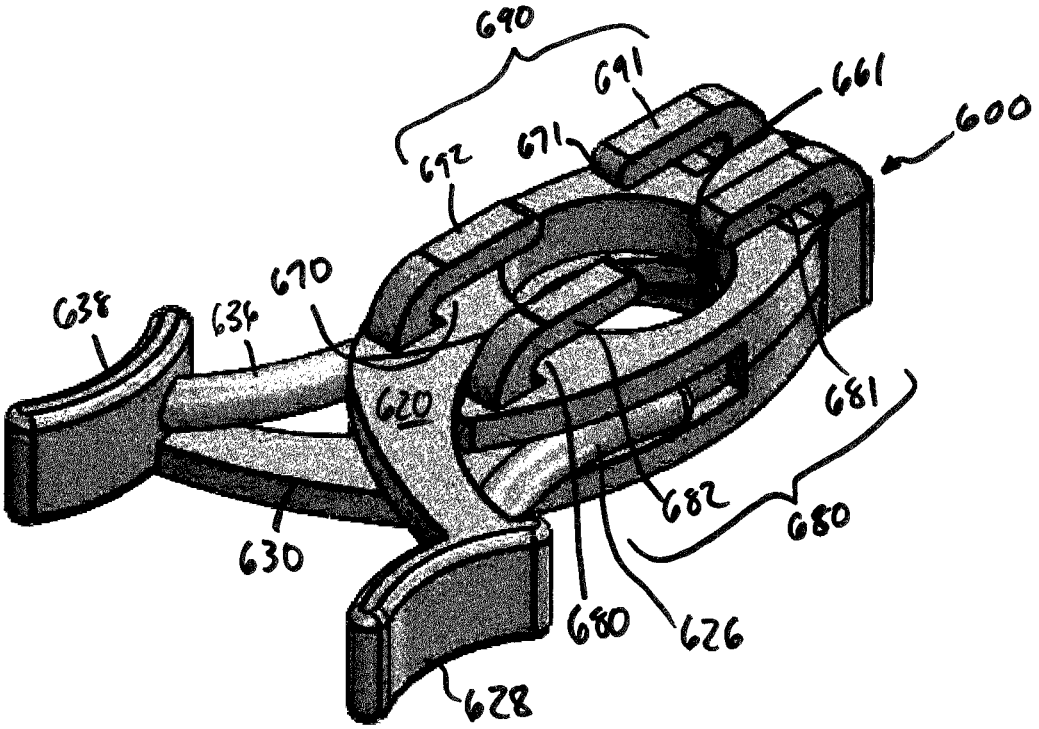
FIG. 20 is a rear perspective view of the receiving portion of FIG. 18, in accordance with an exemplary embodiment of the present invention.
Figure 21:
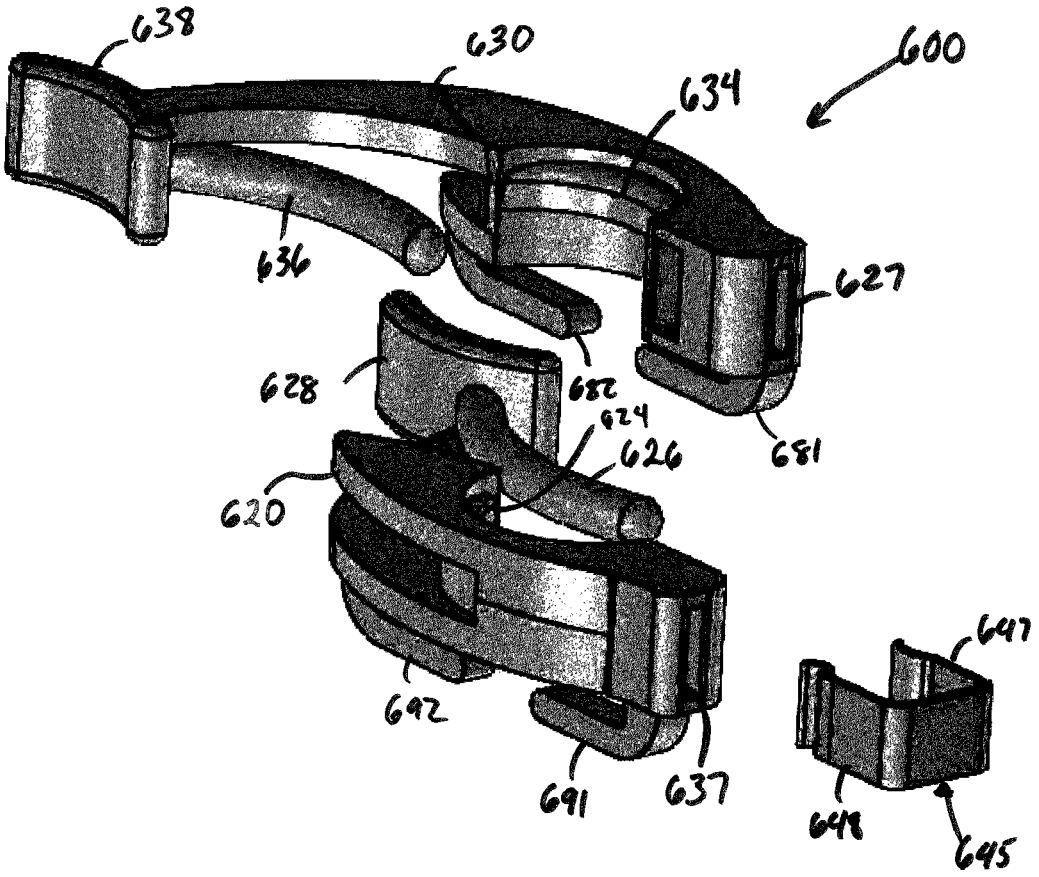
FIG. 21 is an exploded view of the receiving portion of FIG. 18, in accordance with an exemplary embodiment of the present invention.

The first arm 620 further comprises a spring extension 626 extending from the furthest extent 628, and the second arm 630 further comprises a spring extension 636 extending from the furthest extent 638. When the first and second arms 620, 630 are disposed in the resting position in FIGS. 18 and 20, the spring extensions 626, 636 may also be in a resting position, as illustrated in FIGS. 18 and 20. When a compressing force is applied to the first arm 620 and the second arm 630, the spring extension 626 makes contact with the outer surface 621 of the first arm 620, and the spring extension 636 makes contact with the outer surface 631 of the second arm 630. When in contact with the respective outer surfaces 621, 631, the spring extensions 626, 636 resist the compression forced applied to the first arm 620 and the second arm 630 to urge the widths, $w_1$ and $w_2$, to return to their first values.

When the first arm 620 and second arm 630 are released and the user disengages the extents 628, 638, the spring extensions 626, 636 urge the widths, $w_1$ and $w_2$, to return to their first values. The receiving portion 600 and its components may be made of a resilient plastic or metal material having a tendency to create a spring effect allowing the arms 620, 6430 to easily move between compressed and released positions.

The protrusion 496 of the protrusion portion 490 is securable within the cavity 640 by a frictional fitting of the protrusion 496 into the cavity 640. The frictional fitting of the protrusion 496 into the cavity 440 creates a secure association of the at least one bag pocket 102 to the main bag body 104.

The spring clamp 645 of the receiving portion 600 connects the arms 620, 630 together and provides a pivot point between the arms 620, 630. The clamp 645 is similar to the clamp 545. The clamp 645 comprises arms 647 and 648 that are disposed within respective openings 627 and 637 of the respective arms 620 and 630. In an exemplary embodiment, the spring clamp 645 resists the arms 620, 630 pivoting away from one another.

Illustrated in FIG. 20 is a view of the rear of the receiving portion 600, in accordance with an exemplary embodiment of the present invention. Disposed on the rear of the arm 620 are extensions 691 and 692, and disposed on the rear of the arm 630 are extensions 681 and 682. The extensions 691 and 692 extend up and out of the plane of the arm 620 in a direction perpendicular to the plane of the arm 620 and curve toward one another in a plane parallel to the plane of the arm 620. The extensions 681 and 682 extend up and out of the plane of the arm 630 in a direction perpendicular to the plane of the arm 630 and curve toward one another in a plane parallel to the plane of the arm 630. The extensions 691 and 692 form a strap retainer 690, and the extensions 681 and 682 form a strap retainer 680. The strap retainer 690 has a C-shape having an opening 671 for receiving a portion of a strap, and the strap retainer 680 has a C-shape having an opening 661 for receiving another portion of the same strap or another strap. The strap is inserted into the C-shaped strap retainer 680 and 690 by orienting the strap in a plane that is perpendicular to the plane in which the arms 620 and 630 are disposed and perpendicular to the longitudinal axis of the receiving portion 600. The location of the strap retainer 680, 690 on the rear of the respective arms 630, 620 facilitates securing the receiving portion 600 to a strap of a bag and subsequent attachment of the protrusion portion 490 to the receiving portion 600.

In an exemplary embodiment the spring extensions 626, 636 are thin members sized to be flexible. The arms 620, 630 may be formed from a flexible plastic to provide for the flexibility of the spring extensions 626, 636. Any known flexible plastic, such as nylon, polypropylene, etc., may be used for the arms 620, 630. Alternatively, the arms 620, 630 may be formed from a metal, such as aluminum, spring steel, etc. It is also contemplated that the arms 620, 630 may be formed from other materials other than plastics or metals. Such other materials may include carbon fibers, Kevlar® weaves, etc.

Figure 22:
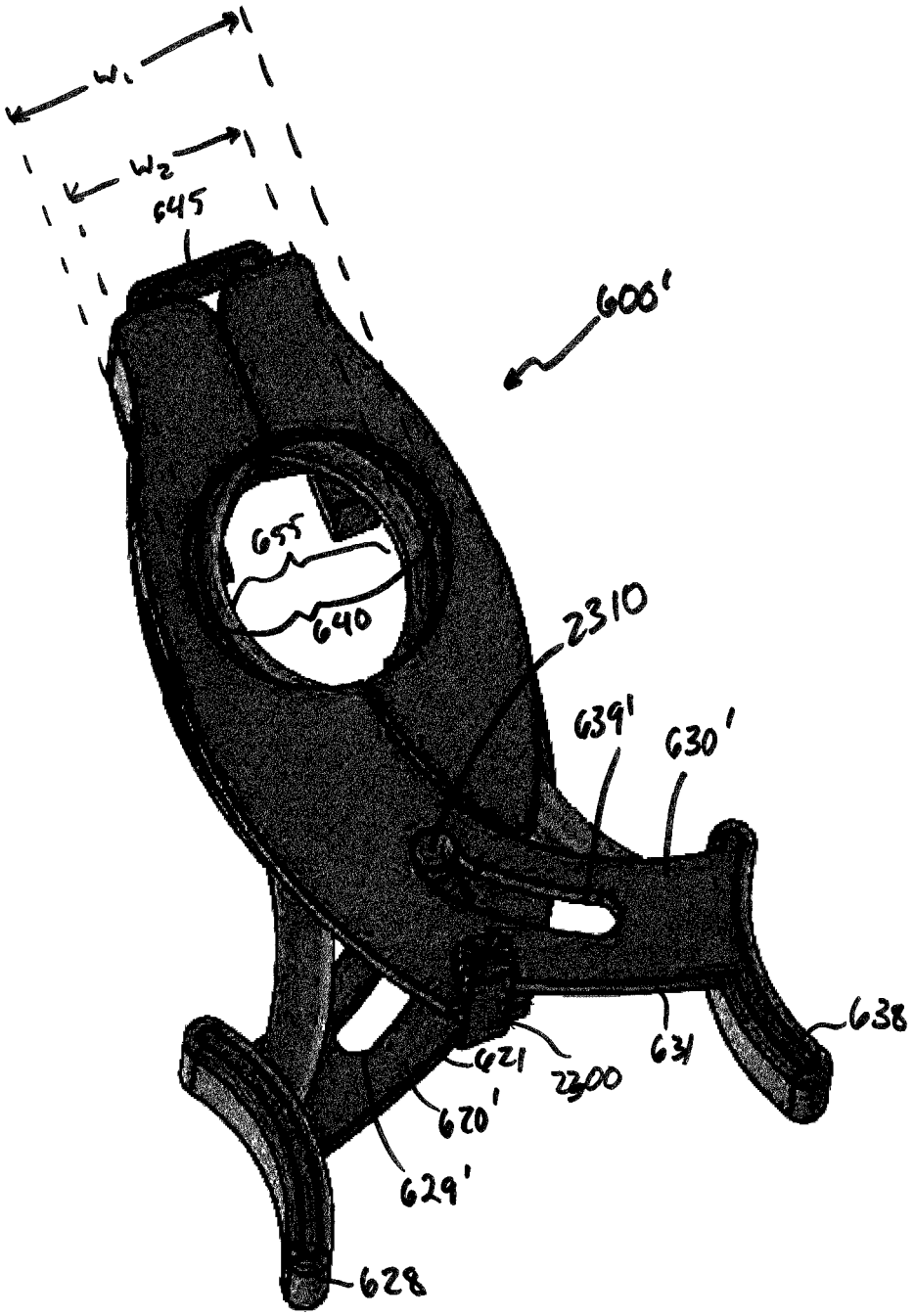
FIG. 22 is a perspective view of still yet another embodiment of a receiving portion comprising a locking component, in accordance with an exemplary embodiment of the present invention.
Figure 23:
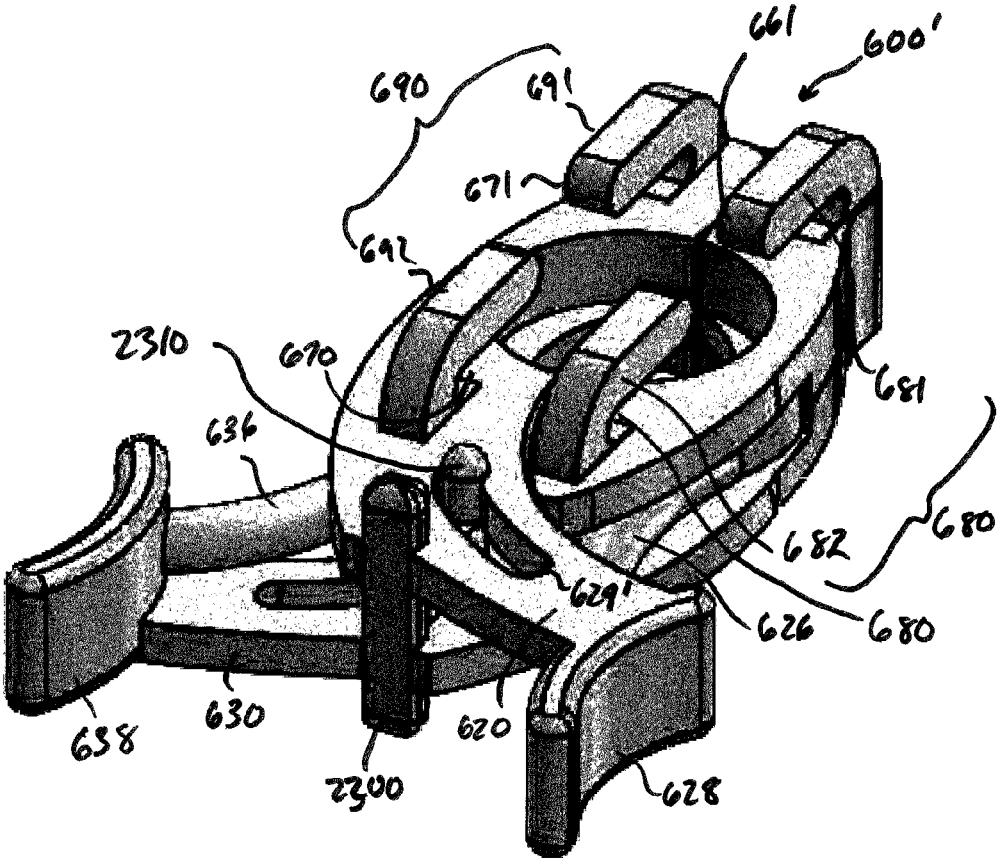
FIG. 23 is a rear perspective view of the receiving portion of FIG. 22, in accordance with an exemplary embodiment of the present invention.
Figure 24:
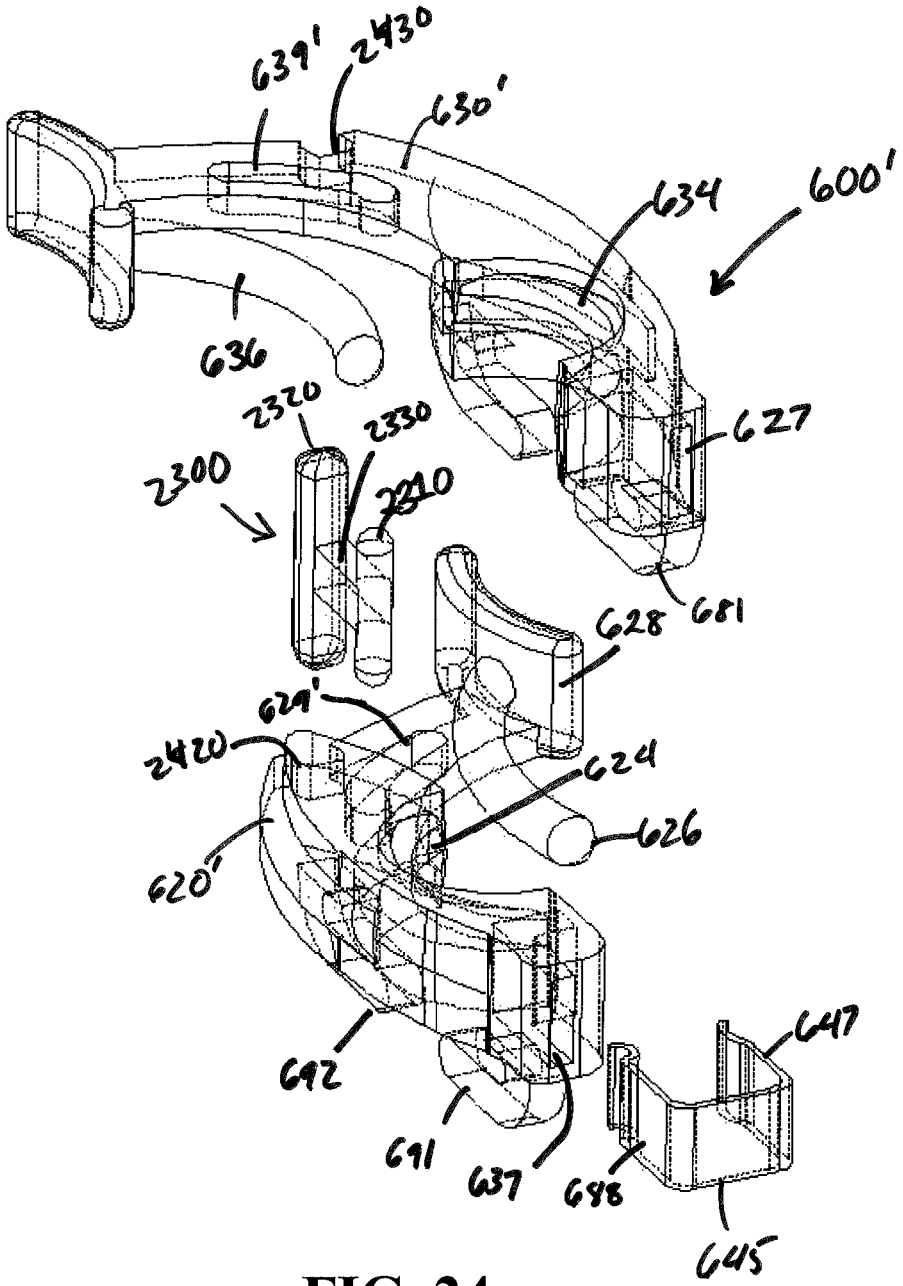
FIG. 24 is an exploded view of the receiving portion of FIG. 22, in accordance with an exemplary embodiment of the present invention.

Referring now to FIGS. 22-24, there is illustrated an exemplary alternative embodiment of the receiving portion 600, which exemplary alternative embodiment is generally designated as 600', in accordance with an exemplary embodiment of the present invention. The receiving portion 600' is generally similar to the receiving portion 600 but differs in several aspects. The receiving portion 600' comprises an arm 620' and an arm 630' and further comprises a locking component 2300. The arms 620' and 630' are generally similar to the arms 620 and 630 but further comprise respective slots 629' and 639'.

The locking component 2300 comprises a first pin 2310, a second pin 2320, and a bridge or cross-support member 2330 connecting the midpoint of the first pin 2310 with the midpoint of the second pin 2320. In an exemplary embodiment, the second pin 2320 is longer than the first pin 2310, thereby giving the locking component 2300 an asymmetrical H shape.

A first end of the first pin 2310 is sized to be disposed within the slot 639', and a second end of the first pin 2310 is sized to be disposed within the slot 629'. The first and second ends of the pin 2310 are sized to be slidably translatable in the respective slots 639', 629'.

The arm 620' further comprises a slot 2420, and the arm 630' further comprises a slot 2430. A first end of the second pin 2320 is sized to be disposed within the slot 2430, and a second end of the second pin 2620 is sized to be disposed within the slot 2420. The slots 629', 639', 2420, 2430 and the locking component 2300 comprise a locking mechanism.

The locking mechanism is locked when the pin 2320 is disposed within the slots 2420, 2430. When the locking mechanism is locked, the locking component 2300 prevents the arms 620', 630' from pivoting because the second pin 2320 is disposed within the slots 2420, 2430. The locking component 2300 thereby prevents the cavity 640 from opening and, therefore, prevents the protrusion 429, if disposed within the cavity 640, from being removed.

The locking mechanism is not locked when the pin 2320 is not disposed within the slots 2420, 2430. When locked, the locking mechanism is unlocked by a user grasping the pin 2320 and pulling it in a direction away from the cavity 640 to remove the pin 2320 from the slots 2420, 2430. The arms 620', 630' may then be compressed to open the cavity 640 to insert or remove the protrusion 496. To lock, the arms 620', 630' are released and the pin 2320 is pushed into the slots 2420, 2430.

Figure 25:
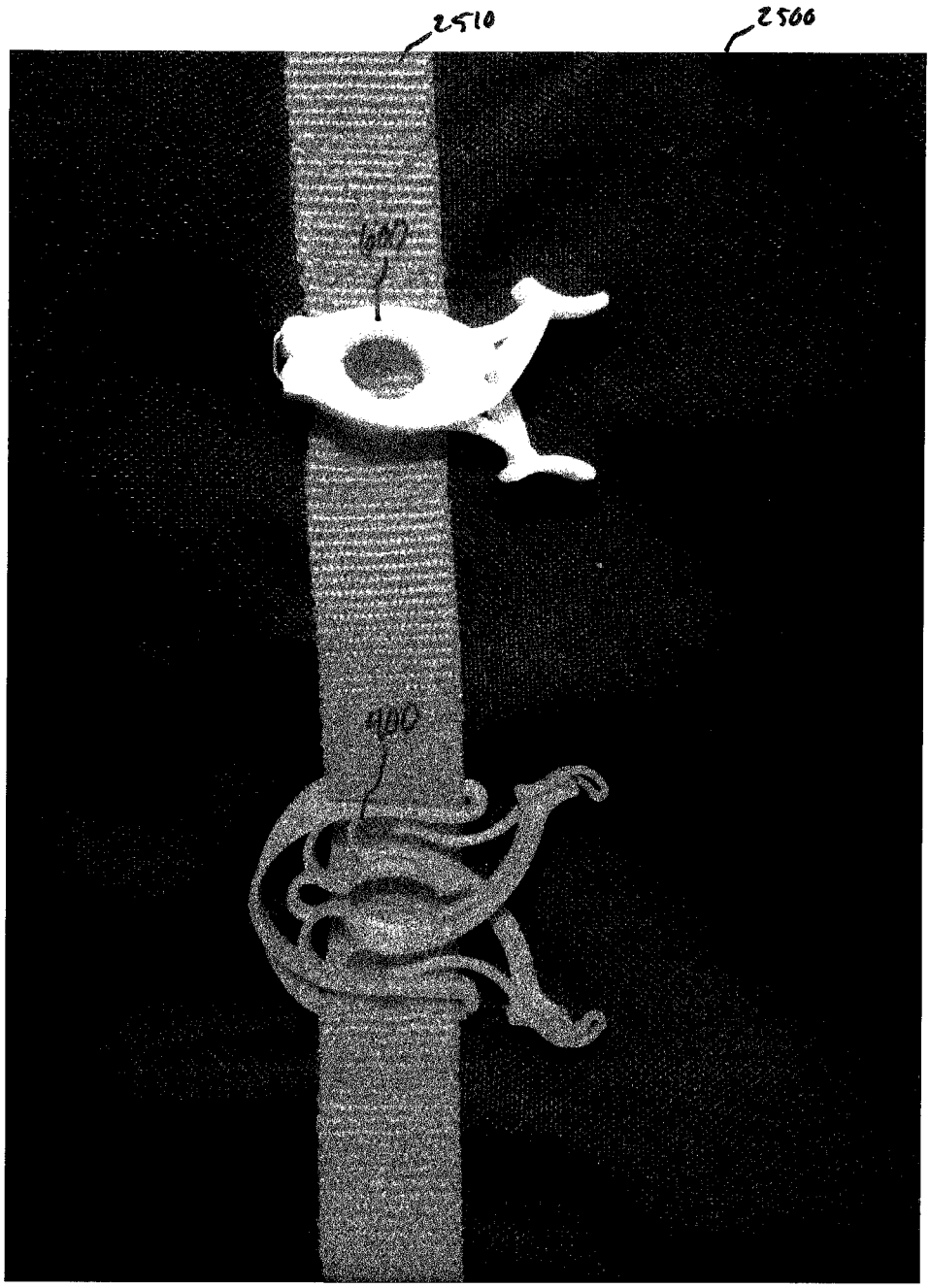
FIG. 25 is a view of a bag comprising a strap on which the receiving portions of FIGS. 12 and 18 are secured, in accordance with an exemplary embodiment of the present invention.

FIG. 25 illustrates an exemplary embodiment of a portion of a bag 2500, in accordance with an exemplary embodiment of the present invention. The bag 2500 comprises at least one strap on which the receiving portions 400 and 600 are secured.

These and other advantages of the present invention will be apparent to those skilled in the art from the foregoing specification. Accordingly, it is to be recognized by those skilled in the art that changes or modifications may be made to the above-described embodiments without departing from the broad inventive concepts of the invention. It is to be understood that this invention is not limited to the particular embodiments described herein, but is intended to include all changes and modifications that are within the scope and spirit of the invention.

What is claimed is:

1. A clasp comprising:

a protrusion portion comprising a protrusion;

a receiving portion comprising a body having a central portion, a first side portion and a second side portion, said receiving portion further having a first arm, and a second arm, the first and second arms defining a receiving cavity configured to receive the protrusion of the protrusion portion, the first arm connected to the first side portions of the body by a plurality of first flexible connectors and the second arm connected to the second side portions of the body by a plurality of second flexible connectors, wherein the protrusion is removably received in the cavity to engage the protrusion portion with the receiving portion.

2. The clasp of claim 1, wherein each of the first arm and the second arm include a furthest extent from the central portion, wherein a width of the cavity has a first value when the first arm and the second arm are in a rest position, the width being adjustable to a second value when an inward compression force is applied to the furthest extent of the first arm and the furthest extent of the second arm such that a distance between the furthest extents of the first arm and the second arm is decreased, and wherein the second value is greater than the first value.

3. The clasp of claim 2, wherein the protrusion includes a major protrusion diameter and a minor protrusion diameter, and wherein the second value of the width of the cavity is greater than the major diameter of the protrusion so as to allow the protrusion to be placed into and to be released from the cavity via the compression force applied to the first arm and the second arm.

4. The clasp of claim 1, wherein the receiving portion includes at least one strap slot configured to secure the receiving portion to at least one strap.

5. The clasp of claim 1, wherein:

the first arm comprises an inner surface, and outer surface, and a spring extension, and the second arm comprises an inner surface, and outer surface, and a spring extension.

6. The clasp of claim 5, wherein the spring extension of the first arm is positioned to compress against the outer surface of the second arm and the spring extension of the second arm is positioned to compress against the outer surface of the first arm when a compression is applied to the first and second arms, thereby resisting opening of the cavity of the receiving portion.

7. A clasp comprising:

a protrusion portion comprising a protrusion;

a receiving portion comprising a spring assembly having at least one spring, a first arm, and a second arm, the first and second arms defining a receiving cavity configured to receive the protrusion of the protrusion portion, the first arm and the second arm biased toward one another by the at least one spring to resist opening of the cavity, wherein the protrusion is removably received in the cavity to engage the protrusion portion with the receiving portion.

8. The clasp of claim 7, wherein each of the first arm and the second arm include a furthest extent, wherein a width of the cavity has a first value when the first arm and the second arm are in a rest position, the width being adjustable to a second value when an inwardly compression force is applied to the furthest extent of the first arm and the second arm such that a distance between the furthest extents of the first arm and the furthest extent of the second arm is decreased, and wherein the second value is greater than the first value.

9. The clasp of claim 8, wherein the protrusion includes a major protrusion diameter and a minor protrusion diameter, and wherein the second value of the width of the cavity is greater than the major diameter of the protrusion so as to allow the protrusion to be placed into and to be released from the cavity via the compression force applied to the first arm and the second arm.

10. The clasp of claim 7, wherein the receiving portion includes at least one strap slot configured to secure the receiving portion to at least one strap.

11. The clasp of claim 7, wherein:

the first arm comprises an extension, and the second arm comprises an extension, wherein the spring assembly is disposed between the extension of the first arm and the extension of the second arm.

12. The clasp of claim 11, wherein the spring assembly comprises a first spring and a second spring, the first spring disposed between the extension of the first arm and an outer surface of the first arm, the second spring disposed between the extension of the second arm and an outer surface of the second arm, wherein the first spring resists movement of the first arm toward a first end of the spring assembly, and wherein the second spring resists movement of the second arm toward a second end of the spring assembly, thereby resisting opening of the cavity of the receiving portion.

13. The clasp of claim 7, further comprising a clip securing the first and second arm together.

14. A clasp comprising:

a protrusion portion comprising a protrusion;

a receiving portion comprising a body, a first rigid arm having a first proximal end and a first distal end, a second rigid arm having a second proximal end and a second distal end, and a flexible spring clamp, the first and second arms defining a receiving cavity configured to receive the protrusion of the protrusion portion, the spring clamp coupled to the first proximal end and the second proximal end to flexibly secure the first arm to the second arm, wherein the protrusion is removably received in the cavity to engage the protrusion portion with the receiving portion.

15. The clasp of claim 14, wherein each of the first arm and the second arm include a furthest extent at the first distal end and second distal end respectively, wherein a width of the cavity has a first value when the first arm and the second arm are in a rest position, the width being adjustable to a second value when an inward compression force is applied to the furthest extent of the first arm and the furthest extent of the second arm such that a distance between the furthest extents of the first arm and the second arm is decreased, and wherein the second value is greater than the first value.

16. The clasp of claim 15, wherein the protrusion includes a major protrusion diameter and a minor protrusion diameter, and wherein the second value of the width of the cavity is greater than the major diameter of the protrusion so as to allow the protrusion to be placed into and to be released from the cavity via the compression force applied to the first arm and the second arm.

17. The clasp of claim 14, wherein the receiving portion includes at least one strap slot configured to secure the receiving portion to at least one strap.

18. The clasp of claim 14, wherein:

the first arm comprises an inner surface, an outer surface, and a spring extension, and the second arm comprises an inner surface, an outer surface, and a spring extension.

19. The clasp of claim 18, wherein the spring extension of the first arm is positioned to compress against the outer surface of the second arm and the spring extension of the second arm is positioned to compress against the outer surface of the first arm when a compression is applied to the first and second arms, thereby resisting opening of the cavity of the receiving portion.

20. The clasp of claim 14, further comprising a locking component configured to releasably lock the first arm to the second arm to prevent the first arm from pivoting with respect to the second arm when the locking component is in a locking position.

* * * * *